US005909226A

United States Patent [19]

Takeda

[11] Patent Number: 5,909,226

[45] Date of Patent: Jun. 1, 1999

[54] APPARATUS FOR FORMING IMAGES

[75] Inventor: Akio Takeda, Yokohama, Japan

[73] Assignee: Canon Kabushiki Kaisha, Tokyo, Japan

[21] Appl. No.: 08/680,805

[22] Filed: Jul. 16, 1996

[30] Foreign Application Priority Data

Jul. 18, 1995 [JP] Japan ..... 7-203902
Jun. 26, 1996 [JP] Japan ..... 8-185580

[51] Int. Cl.[6] ..... B41J 2/01

[52] U.S. Cl. ..... 347/3; 347/108; 346/145

[58] Field of Search ..... 347/108, 3, 104, 347/222; 346/145; 399/124

[56] References Cited

U.S. PATENT DOCUMENTS 4,651,173 3/1987 Ozawa ..... 347/108 X
4,737,804 4/1988 Ayata ..... 347/3

FOREIGN PATENT DOCUMENTS 4-101154 4/1992 Japan ..... B41J 2/01

*Primary Examiner*—Joseph Hartary
*Attorney, Agent, or Firm*—Fitzpatrick, Cella, Harper & Scinto

[57] ABSTRACT

An apparatus for forming images that records images on a recording material by use of recording means includes an upper frame and a lower frame. The upper frame is installed to be opened and closed with respect to the lower frame by means of a rotational center in the direction along the feeding direction of the recording material. The lower frame is provided with a recording material carrying mechanism and means for installing the recording means. Then, it is arranged to suspend the recording means in a location on the rotational center side out of the recording material carrying area of the apparatus main body when the upper frame is opened or closed with respect to the lower frame. In this way, when a recording material is jammed in the interior of the apparatus main body, it is easy for the operator to carry out jamming disposal without touching recording means with his hand. Hence, there is no possibility to get the adjusted position of recording means out of order.

14 Claims, 19 Drawing Sheets

APPARATUS FOR FORMING IMAGES

BACKGROUND OF THE INVENTION

1. Field of the Invention

The present invention relates to an apparatus for forming images that records images on a recording medium by use of recording means.

2. Related Background Art

An apparatus for forming images, which is provided with the functions of a printer, a copying machine, facsimile equipment, and the like, or an apparatus for forming images, which is used as output equipment for a complex machine including a computer, a word processor, and the like, and as output equipment for a work station, is structured to form (record) images (including characters, symbols, and the like) on a recording material (recording medium) such as a paper sheet, and a thin plastic sheet (sheet for OHP use or the like). The recording methods adopted for such apparatus for forming images are classified into an electronic photographic type, an ink jet type, a wire-dot type, a thermosensitive type, a thermal transfer type, a laser beam type, and others.

In a serial type apparatus for forming images that records while scanning in a direction intersecting the feeding direction or the rotational direction (sub-scanning direction) of a recording material, images (including characters, symbols, and others) are recorded by a head mounted on a carriage that travels along the recording material after the recording material is set at a given recording position. Then, a recording operation for a portion of a given width and a sheet feeding operation for a given amount are executed in synchronism in order to form images on the recording material. On the other hand, in a line type apparatus for forming images that records only in the sub-scanning direction, which is the feeding direction of a recording material, a recording material is set at a given recording position, and the sheet feeding is performed for a given amount, while images are formed collectively for a one line portion continuously.

The ink jet type apparatuses for forming images described above are structured to record on a recording material by discharging ink onto a recording material from an ink jet head serving as recording means. Therefore, it is possible to fabricate the head compactly with ease; to form highly precise images at high speeds; to perform recording on an ordinary paper without any particular treatment; to operate recording at low running costs; to create a smaller amount of noises because of the non-impact type adopted for this recording; and also, to record color images easily by use of multiple color ink, among other advantages. Of these types, a line type apparatus for forming images that uses the line type recording head, which is provided with many numbers of discharge ports arranged in the sheet width direction, makes it possible to form images at higher speeds.

Particularly, the ink jet type recording head that discharges ink by the application of thermal energy can be fabricated easily with a highly densified arrangement of liquid paths (discharge ports) by forming electrothermal transducing elements, electrodes, walls of liquid paths, ceiling plate, and the like on a base board by means of thin film formation through etching, sputtering, and other semiconductor fabrication processes. In this way, the ink jet type recording head can be made more compactly. Also, it is possible to prepare the recording means thereof in an elongated configuration or to surface (two-dimentionally arranged) it with ease so as to facilitate the provision of full line multiple nozzles and the execution of highly densified assembling of recording means.

In an apparatus for forming images of this kind, a front door 101 arranged for a part of the front cover of the apparatus main body shown in FIG. 20 is open for a manual recovery operation by the operator who inserts his hand into the apparatus main body through the portion thus opened if a jamming (sheet clogging) of a recording material takes place in the interior of the apparatus main body when the recording material is being fed or carried. Also, for the ink jet recording apparatus, ink tanks retaining ink to supply it to each of the recording heads are exchanged manually by the operator likewise after opening the front door, or as shown in FIG. 20, a holder unit 103 holding ink tanks 102*a* to 102*d* is drawn out in the direction indicated by an arrow Z for exchanging ink tanks in order to provide a supply of ink.

Also, by the combination of the apparatus for forming images and an image reading device, it is possible to structure a copying machine. Here, in consideration of the requirements of the installation space and operativity of the apparatus, it is most effective to arrange, as shown in FIG. 20, the apparatus for forming images in the lower part and the image reading device above it at the same time.

However, in accordance with the conventional apparatus for forming images, the jamming disposal of a recording material is operated manually by the operator by opening the door and inserting his hand through the aperture thus opened. Therefore, there are disadvantages that it is difficult to observe the jamming condition of recording material by sight and remove it from the interior of the apparatus main body because the height and width dimensions of the aperture are not large enough particularly for a small color recording apparatus, color copying machine, or the like. Also, there is a drawback that it is difficult to exchange ink tanks by opening the front door as in the case of the operation of jamming disposal because of the limited dimensions of aperture height and width if the ink tanks are on the inner side of the aperture.

Also, regarding the conventional apparatus for forming images structured as shown in FIG. 20, for example, there is a drawback that it is difficult to observe by sight and execute the removal of a jammed recording material from the interior of the main body of the apparatus. Further, a holder unit 103 should be arranged in order to mount or demount ink tanks. In this case, not only the costs of manufacture are increased, but also, there is a fear that ink is spilt when the holder unit 103 is drawn out or pushed in (the liquid surface is undulated due to vibration). An extra space should also be provided on the sheet exhaust side for drawing out the holder unit 103, among other disadvantages.

Further, in accordance with the conventional apparatus for forming images structured as shown in FIG. 20, for example, there is a disadvantage that it is not easy to exchange recording heads, because an image reading device is arranged above the recording head. Also, there is a disadvantage that when the position of the recording head should be adjusted, it is not easy to operate the required positional adjustment from above the recording head, because the image reading device is arranged above it. In this case, it is conventionally practiced that the image reading device is demounted from the main body of the apparatus to release the image recording unit when the recording heads are exchanged or its positions are adjusted. However, since wiring is arranged between the image reading device and the image recording unit for the transmission of various electric signals, it takes a considerable time and trouble just to demount the image reading device. Besides, among other routines needed, the wiring should be removed. Inevitably, therefore, this demounting cannot be operated simply on a small scale.

SUMMARY OF THE INVENTION

It is an object of the present invention to provide an apparatus for forming images that makes it easier to carry out jamming disposal even when a recording material is jammed in the apparatus main body without fear that recording means is touched at the time of jamming disposal to get the adjusted position thereof out of order.

It is another object of the invention to provide an apparatus for forming images that makes it easier to carry out jamming disposal even when a recording material is jammed in the apparatus main body without fear that recording means is touched at the time of jamming disposal to get the adjusted position thereof out of order, and further, to provide an apparatus that makes it easier to exchange ink tanks in a state that ink is not spilt from ink tanks incorporated in the apparatus main body without requiring any extra space and increasing the costs of manufacture.

It is still another object of the invention to provide an apparatus for forming images that makes it possible to exchange recording heads and adjust the position thereof easily and quickly without removing an image reading unit.

It is a further object of the invention to provide an apparatus for forming images that records images on a recording material by use of recording means, which is provided with an upper frame and a lower frame. This upper frame is installed to be opened and closed with respect to the lower frame by means of the rotational center in the direction along the feeding direction of the recording material, and for the lower frame, a recording material carrying mechanism and a mounting unit for recording means are arranged: when the upper frame is opened or closed with respect to the lower frame, this recording means is suspended in the main body of the apparatus on the rotational center side out of the recording material carrying area.

It is still a further object of the invention to provide an apparatus for forming images that records images on a recording material by use of recording means, which is provided with an upper frame and a lower frame. This upper frame is installed to be opened and closed with respect to the lower frame by means of the rotational center in a direction intersecting the feeding direction of the recording material, and for the lower frame, a mounting unit is arranged for the recording material carrying mechanism and recording means: when the upper frame is opened or closed with respect to the lower frame, the recording means is suspended outside the recording material carrying area.

It is another object of the invention to provide an apparatus for forming images that records images on a recording material, which is provided with an upper frame and a lower frame. In this lower frame, the recording means is installed. Between the upper and lower frames, a partitioning member is arranged, and an aperture is arranged in a location of the partitioning member above the recording means.

DETAILED DESCRIPTION OF THE PREFERRED EMBODIMENTS

Figure 1:
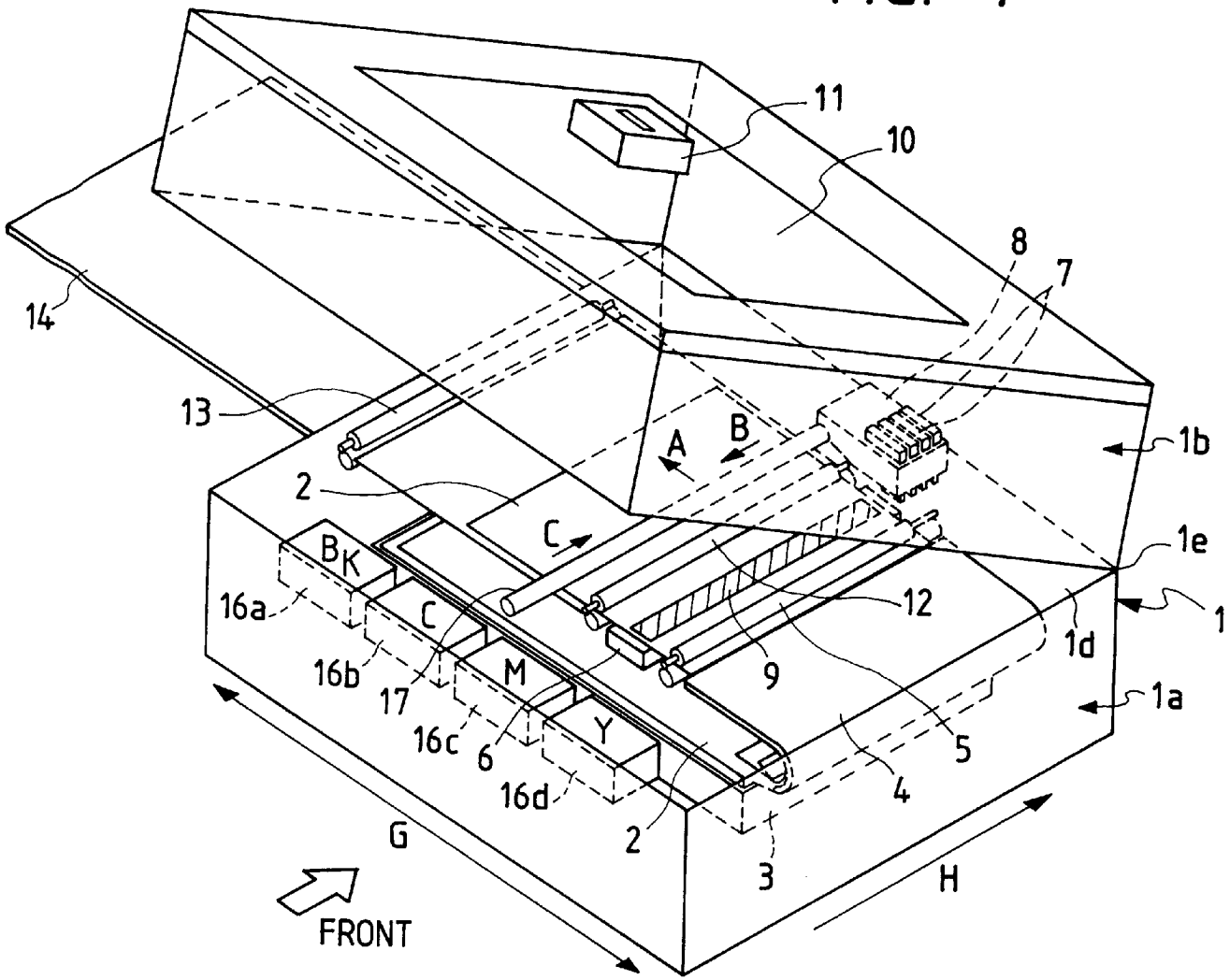
FIG. 1 is a perspective view which schematically shows an apparatus for forming images in accordance with a first embodiment as an embodiment to which the present invention is applicable.

Hereinafter with reference to the accompanying drawings, a description will be provided of the embodiments in accordance with the present invention. In this respect, the same reference marks designate the same or corresponding parts throughout each of the accompanying drawings. FIG. 1 is a perspective view schematically showing an apparatus for forming images in accordance with a first embodiment to which the present invention is applicable. In accordance with the present embodiment, the apparatus for forming images is an ink jet recording apparatus provided with the functions of a copying machine. In FIG. 1, the main body 1 of the apparatus comprises a lower frame la having an image recording unit incorporated in it, and an upper frame 1*b* having an image reading unit incorporated in it.

The upper frame (image reading unit) 1*b* is structured to enable the front face of the apparatus main body 1 to be opened with respect to the lower frame (image recording unit) 1*b* by means of the rotational center 1*e* arranged in the rear position of the apparatus main body 1. In other words, the upper frame 1*b* is installed to be able to open and close its front with respect to the lower frame 1*a* by means of the rotational center 1*e* in parallel with the direction along the feeding direction of a recording material, for example. The state represented in FIG. 1 shows support provided by means of springs, such as torsion springs, oil dumper, gas spring or supporting rods (not shown).

In FIG. 1, a cassette 3 is incorporated in the lower frame 1*a* to stack plural sheets of recording material 2. In the cassette 3, a recording material 2 on the top of the stack is separated by sheet feeding means (not shown), and supplied to a first carrier roller 5 through a guide 4, and then, carried to and suspended at the recording start position on a platen 6 by means of the carrier roller 5. Here, the recording carriage 8 having recording means (recording head) 7 mounted thereon travels in the directions indicated by an arrow B and an arrow C along a guide shaft 17, thus recording images by recording means 7 on the image formation area (one line portion) 9 of the recording material 2 indicated by slanted lines.

The guide shaft 17, the recording carriage 8, and the recording head (recording means) 7 are installed on the lower frame (image recording unit) 1*a* side. Also, in accordance with the present embodiment, four recording heads 7 for recording in black, cyan, magenta, and yellow, respectively, are mounted on the carriage 8. It is then structured to obtain full color images on a recording material 2. Also, in order to get the recording positions of the recording heads to agree with each other (that is, to prevent any occurrence of color misregisteration), each of the recording heads is mounted on the carriage after their relative positions (such as parallelism) are mechanically adjusted between them. When one line recording is completed, the recording material 2 is fed by a specific amount in the direction indicated by an arrow A (feeding direction) for the execution of image recording on the next line.

In FIG. 1, a glass 10 for source document use is arranged on the upper surface of the upper frame 1*b*. Images on a source document (not shown) set on this glass 10 are read by optical sensor and others installed on the carriage 11. This reading carriage 11 reads the images on the source document set on the glass 10, while reciprocating in the width direction of the glass 10 for source document use. After having read a one line portion, the reading carriage reads the next line by shifting itself by a specific amount in the longitudinal direction (which is opposite to the feeding direction A of a recording material).

The data read by the reading carriage 11 are transferred as image data from an image processing unit (not shown) to recording means 7. By these functions of a copying machine, information on a source document is recorded on a recording material 2, and then, the recording material 2 is further carried by means of a second carrier roller 12 and a sheet exhaust roller 13 to be exhausted onto a sheet exhaust tray 14. Here, in accordance with the first embodiment shown in FIG. 1, the parts of the carrying mechanism, such as the first carrier roller 5, the second carrier roller 12, and the sheet exhaust roller 13, which are arranged on the upper side of the recording material 2, are also installed on the lower frame (recording unit) 1*a* side.

As recording means (recording head) 7, it is possible to use those means of various types. However, in accordance with the present embodiment, an ink jet recording means is adopted for use. Further, of those ink jet recording types, the one which discharges ink by the utilization of thermal energy is used. In other words, the recording head 7 is provided with electrothermal transducing elements for generating thermal energy. More precisely, this recording head discharges ink from discharge ports for the formation of images by the utilization of pressure changes generated by the development and contraction of bubbles created by film boiling caused by the thermal energy applied by means of the electrothermal transducing elements.

Figure 2:
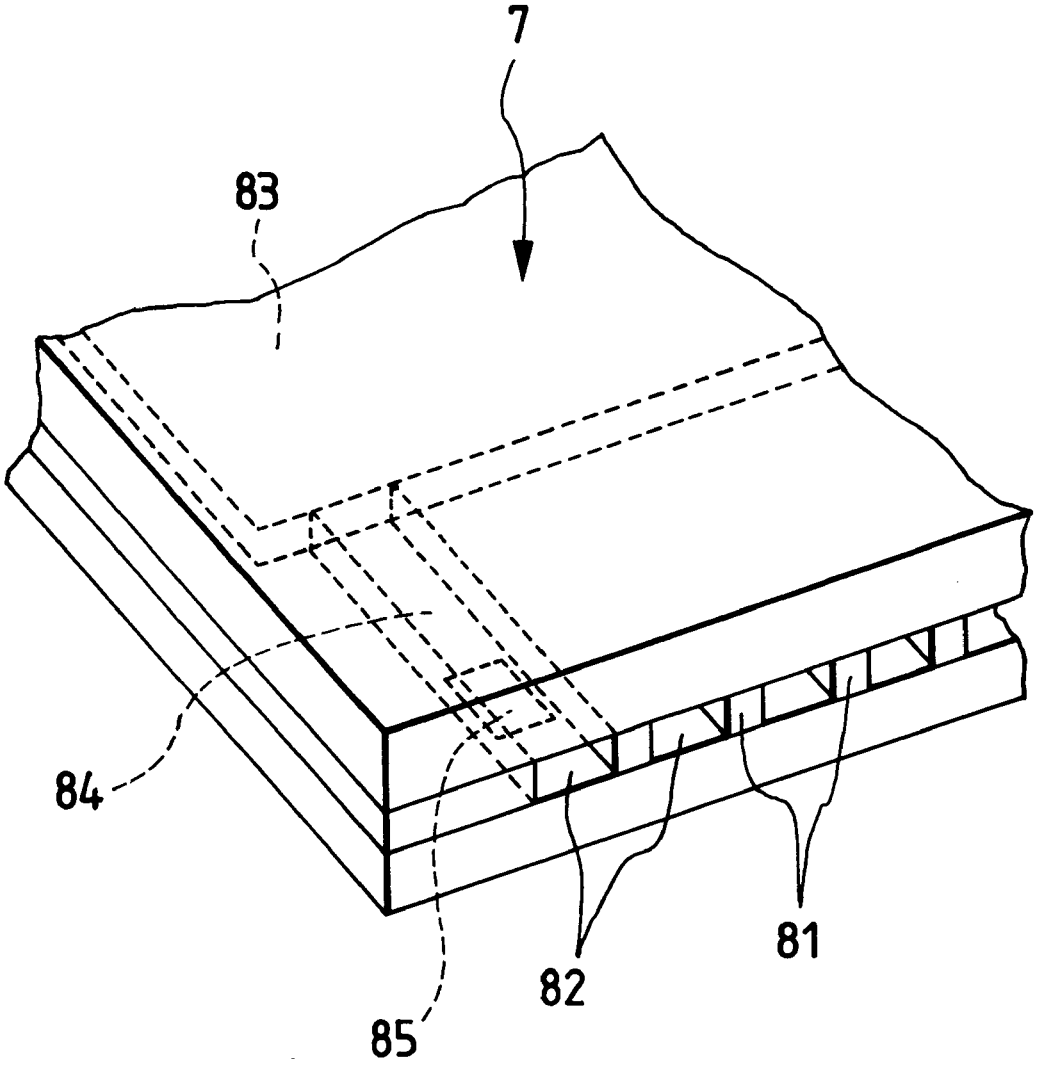
FIG. 2 is a partially perspective view schematically showing the structure of the ink discharge unit of recording means represented in FIG. 1.

FIG. 2 is a partially perspective view which schematically shows the structure of the ink discharge unit of an ink jet recording head 7. In FIG. 2, a plurality of discharge ports 82 are formed at given pitches on the discharge port formation surface (the surface where discharge ports are formed) 81 that faces the recording material 2 with a given gap (of approximately 0.5 to 2.00 mm), and along the wall face of each of the liquid paths that connect a common liquid chamber 83 and each of the discharge ports 82, an electrothermal transducing element (heat generating resistor or the like) 85 is arranged to generate energy for use of ink discharge.

In accordance with the present embodiment, the recording head 7 is mounted on the carriage 8 in a positional relationship such that the discharge ports 82 of the recording head can be arranged in the direction intersecting the traveling direction of the carriage 8 (main scanning direction). It is then structured that the corresponding electrothermal transducing elements 85 are driven (energized) in accordance with image signals or discharge signals so as to create film boiling in ink retained in the corresponding liquid paths 84, and that by pressure thus exerted, the recording head 7 discharges ink from the discharge ports 82.

In FIG. 1, four ink tanks 16*a*, 16*b*, 16*c*, and 16*d* are exchangeably installed in the lower frame 1*a* to retain ink of specific colors to be supplied to each of the four colors (four pieces) of recording heads 7, respectively. As shown in FIG. 1, these ink tanks 16*a* to 16*d* are arranged in the vicinity of the front side, which is opposite to the side where the rotational center 1*e* is provided for the lower frame 1*a*. In other words, these ink tanks are arranged on the side open to the upper frame 1*b*.

Then, the apparatus for forming images shown in FIG. 1 is structured so that when the upper frame (image reading unit) 1*b* is opened or closed with respect to the lower frame (image recording unit) 1*a*, the recording carriage 8 and the recording head 7 are suspended in a location out of the recording material carrying area on the rotational center 1*e* side of the apparatus main body 1 (on the rear portion of the apparatus main body at 1*d*).

Now, a description will be provided of an operation when a recording material 2 is jammed (sheet clogging occurs) in the interior of the main body 1 of the apparatus for forming images shown in FIG. 1. When jamming occurs, the upper frame 1*b* is set at an opening position shown in FIG. 1 by rotating it around the rotational center 1*e*. Since the rotational center 1*e* is arranged in the rear position on the apparatus main body 1, it is possible to form an aperture evenly on the front face side of the apparatus main body when the upper frame 1*b* rotates.

Then, the operator inserts his hand through the aperture thus provided and removes the jammed recording material 2 to complete the jamming disposal. In this case, the front side of the apparatus main body 1 provides a space to form an aperture all over the area in the recording material carrying direction indicated by an arrow G, which is good enough to carry out jamming disposal easily at any place where the recording material 2 is jammed.

Also, the recording head (recording means) 7 and the recording carriage 8 are positioned on the rear portion at 1*d* of the apparatus main body 1. In this respect, the deeper the rear portion (in the direction indicated by an arrow H), the narrower becomes the aperture between the upper frame 1*b* and the lower frame 1*a*. As a result, there is no fear that the operator touches the recording head when he inserts his hand for operating jamming disposal. Here, there is also no possibility to get the adjusted position of the recording head 7 out of order at the time of jamming disposal.

Further, since the first carrier roller 5 and the driving unit (not shown) of the recording carriage 8 are arranged on the rear portion of the lower frame 1*a*, there is almost no possibility that the operator touches them by his hand when operating jamming disposal. Also, the ink tanks 16*a* to 16*d* are arranged in the vicinity of the aperture on the front side of the apparatus main body 1. Therefore, a sufficient space is formed around these ink tanks to make it easier for the operator to replace each of the color ink tanks.

Figure 3:
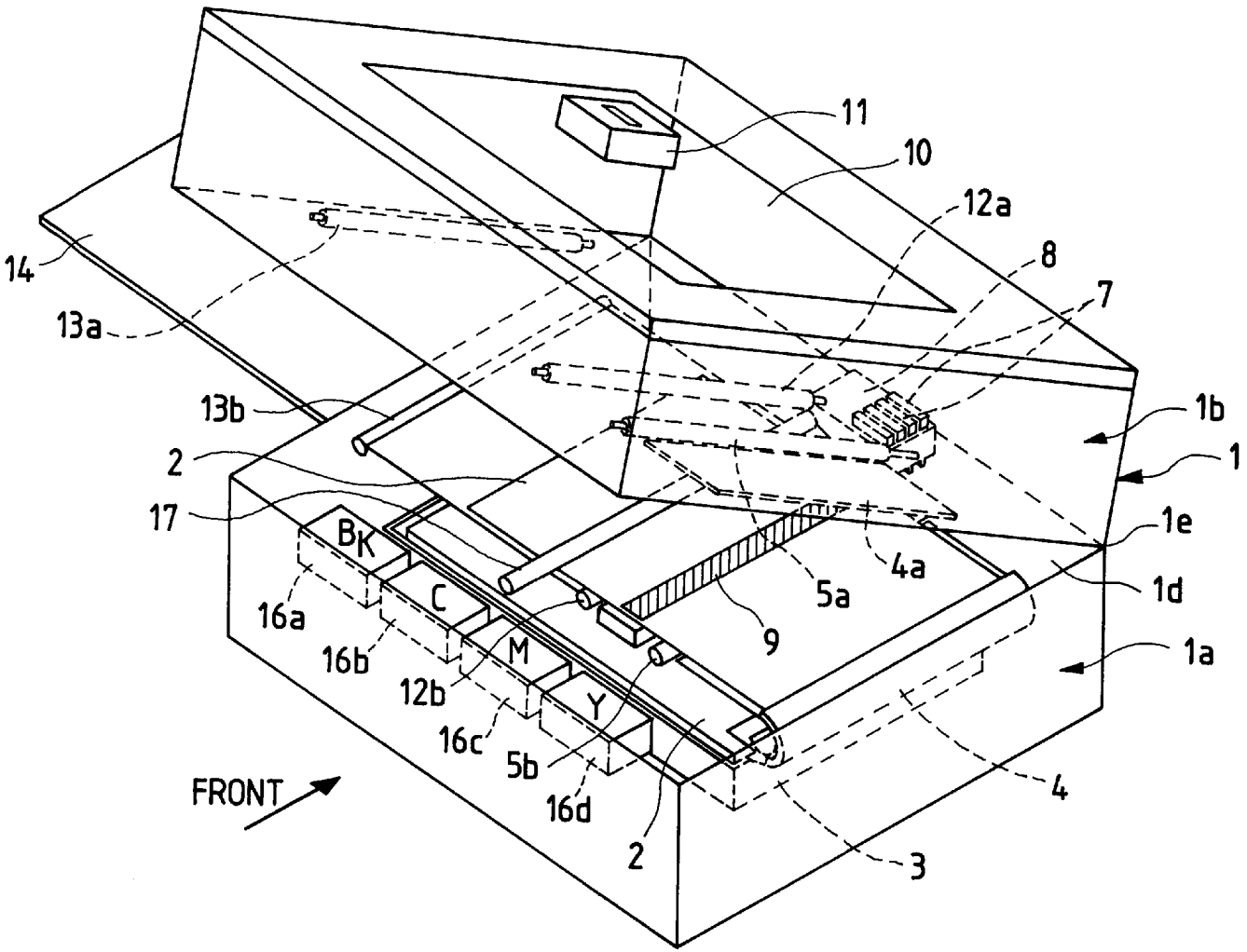
FIG. 3 is a perspective view which schematically shows an apparatus for forming images in accordance with a second embodiment as an embodiment to which the present invention is applicable.

FIG. 3 is a perspective view which schematically shows an apparatus for forming images in accordance with a second embodiment to which the present invention is applicable.

In accordance with the present embodiment, it is structured that the constituents of a carrying mechanism, such as rollers and guides, which are arranged on the upper side of a recording material 2, are installed on the upper frame (image reading unit) 1*b* side, and that when the upper frame 1*b* is opened, these constituents are caused to part from the recording material 2 as the upper frame 1*b* parts from it.

In other words, in accordance with the present embodiment, the structure is arranged so that when the front face of the apparatus main body 1 is opened by rotating the image reading unit 1*b* around the rotational center 1*e*, a part 4*a* of the carrying guide 4 on the upper surface side of a recording material 2, an upper side roller 5*a* of the first carrier roller pair 5*a* and 5*b*, an upper roller 12*a* of the second carrier roller pair 12*a* and 12*b*, and an upper roller 13*a* of the sheet exhaust roller pair 13*a* and 13*b* are displaced by rotation together with the image reading unit 1*b*, and that these parts are caused to part from the recording material 2.

The second embodiment shown in FIG. 3 differs from the first embodiment shown in FIG. 1 in the aspects described above. The other aspects are arranged substantially the same as those of the first embodiment. Therefore, the same reference marks are provided to designate the corresponding parts, and the detailed descriptions thereof will be omitted. In accordance with the second embodiment shown in FIG. 3, the same effects are obtainable as the first embodiment. In addition, it becomes easier to remove a recording material 2, because the recording material 2 is held from the upper and lower sides by the pairs of first and second rollers 5 and 12, sheet exhaust rollers 13, and others. Therefore, the operativity of jamming disposal is further enhanced.

Figure 4:
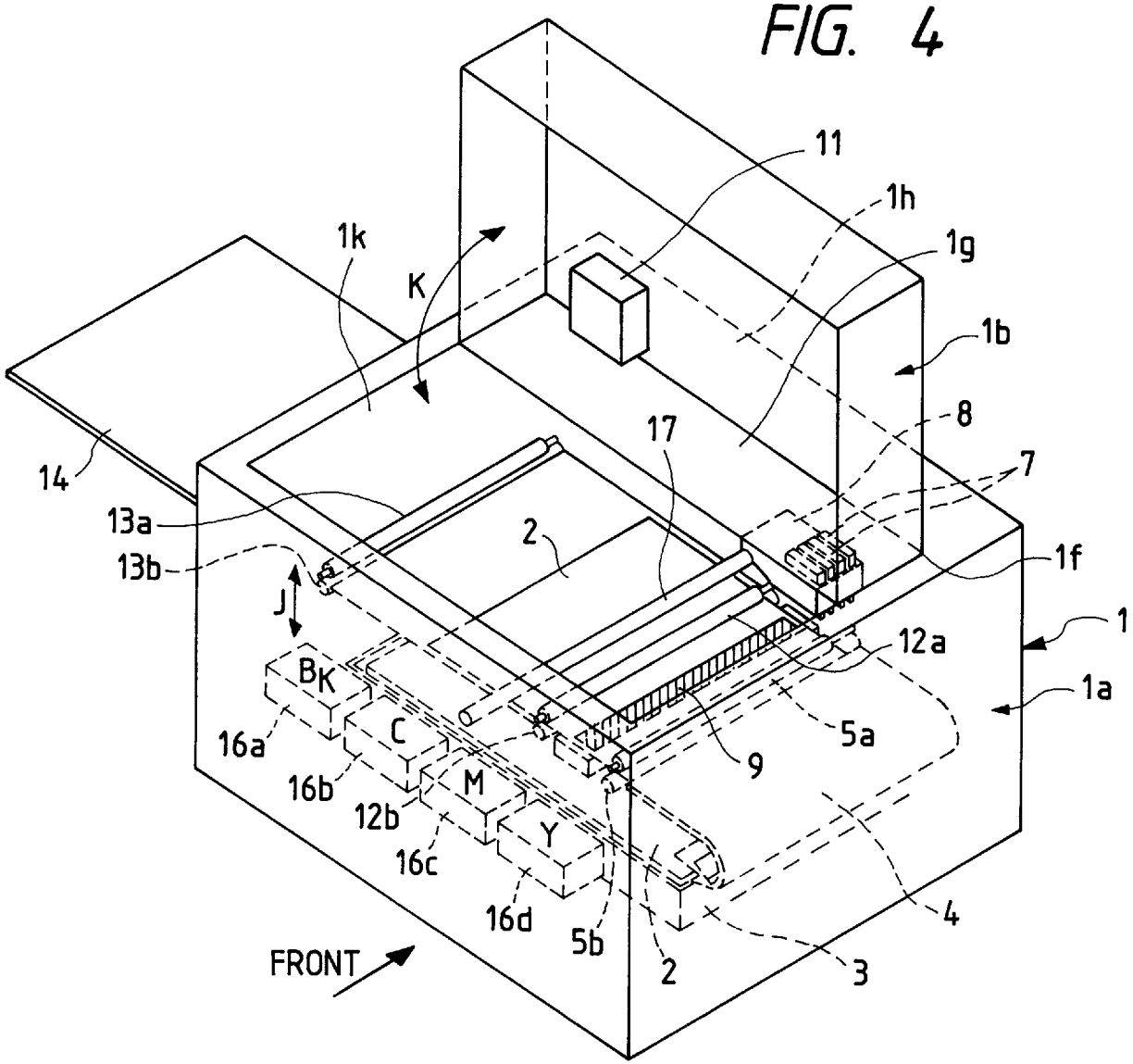
FIG. 4 is a perspective view which schematically shows an apparatus for forming images in accordance with a third embodiment as an embodiment to which the present invention is applicable.

FIG. 4 is a perspective view which schematically shows an apparatus for forming images in accordance a third embodiment to which the present invention is applicable. In accordance with the present embodiment, an image reading unit 1*b* is installed rotatively at an angle of approximately 90 degrees around the rotational center if as indicated by arrows K with respect to an image recording unit 1*a*. FIG. 4 illustrates a state of the reading unit 1*b* being opened at an angle of approximately 90 degrees. Here, it is structured that the rotational center if is positioned slightly forward from the rear face of the apparatus main body 1, and that even when the reading unit 1*b* is in a state that it is open at approximately 90 degrees, the recording head (recording means) 7 and the recording carriage 8 are located below the rear face 1*g* of the image reading unit 1*b* and the rear upper surface 1*h* of the image recording unit 1*a*. Therefore, it is not easy for the operator to touch them by his hand when he inserts it from the aperture 1*k* (being formed when the reading unit 1*b* is opened) of the apparatus main body 1.

The third embodiment shown in FIG. 4 differs from the first embodiment shown in FIG. 1 in these aspects. The other aspects are substantially the same as those of the first embodiment. Therefore, a detailed description thereof will be omitted. In accordance with the third embodiment shown in FIG. 4, the reading unit 1*b* is open at approximately 90 degrees. Therefore, as in the first embodiment shown in FIG. 1, it is easy to operate jamming disposal at any place where a recording material 2 is jammed. Also, there are no obstacles above the ink tanks 16*a* to 16*d* in the direction indicated by an arrow J. As a result, it is easy for the operator to exchange the ink tanks by inserting his hand from the aperture 1*k* of the apparatus main body 1.

In accordance with the first to third embodiments described above, it is equally possible to obtain a space good enough to carry out jamming disposal in any position in the recording material carrying direction when the recording material 2 is jammed in the apparatus main body 1. Therefore, it is possible to provide an apparatus for forming images that makes it easier to carry out jamming disposal.

Also, it is possible to eliminate any fear that the operator touches recording means (recording head) 7 carelessly at the time of jamming disposal. As a result, there is no possibility to get the adjusted position of the recording head out of order. It is also possible to provide an apparatus for forming images that makes it easier to exchange all the ink tanks irrespective of its positions even when a plurality of ink tanks are mounted in order to retain ink for its ink jet recording apparatus.

Figure 5:
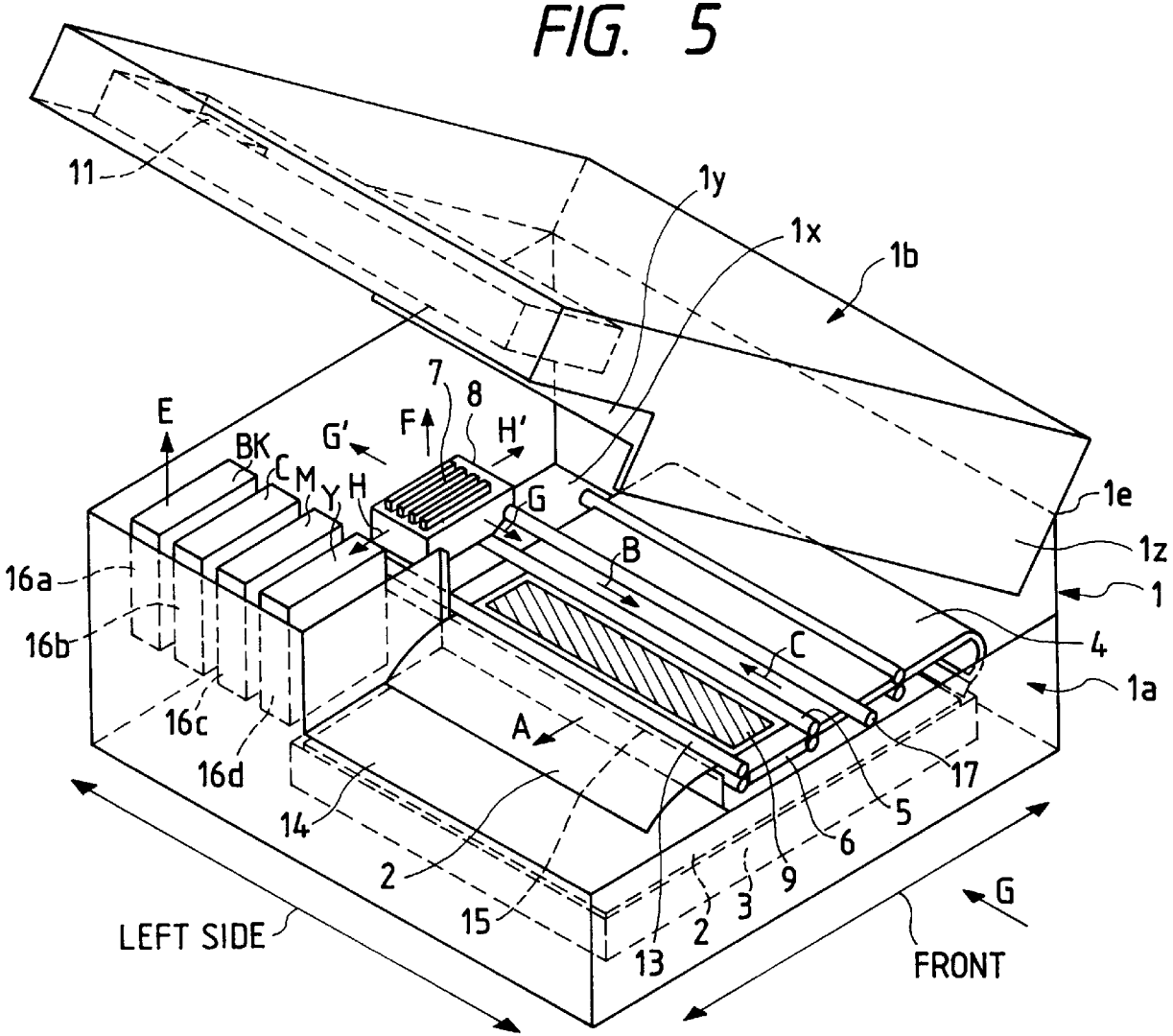
FIG. 5 is a perspective view which schematically shows an apparatus for forming images in accordance with a fourth embodiment as an embodiment to which the present invention is applicable.

FIG. 5 is a perspective view which schematically shows an apparatus for forming images in accordance with a fourth embodiment to which the present invention is applicable. The present embodiment, too, represents a case where the apparatus for forming images is an ink jet recording apparatus provided with the functions of a copying machine. In FIG. 5, the apparatus main body 1 comprises a lower frame 1*a* having an image reading unit incorporated in it, and an upper frame 1*b* having an image reading unit incorporated in it.

The upper frame (image reading unit) 1*b* is structured to enable the left side face of the apparatus main body 1 to be opened with respect to the lower frame (image recording unit) 1*b* by means of the rotational center 1*e* arranged in a position on the right side face of the apparatus main body 1. In other words, the upper frame 1*b* is installed to be able to open and close its left side face with respect to the lower frame 1*a* by means of the rotational center 1*e* in a direction intersecting (orthogonal to) the feeding direction of a recording material, for example. The state represented in FIG. 5 shows support provided by means of springs, such as torsion springs, oil dumper, gas spring or supporting rods (not shown).

In FIG. 5, a cassette 3 is incorporated in the lower frame 1*a* to stack plural sheets of recording material 2. In the cassette 3, a recording material 2 on the top of the stack is separated by sheet feeding means (not shown), and supplied to a first carrier roller 5 through a guide 4, and then, carried to and suspended at the recording start position on a platen 6 by means of the carrier roller 5. Here, the recording carriage 8 having recording means (recording head) 7 mounted thereon travels in the directions indicated by an arrow B and an arrow C along a guide shaft 17, thus recording images by recording means 7 on the image formation area (one line portion) 9 of the recording material 2 indicated by slanted lines.

The guide shaft 17, the recording carriage 8, and the recording head (recording means) 7 are installed on the lower frame (image recording unit) 1*a* side. Also, in accordance with the present embodiment, four recording heads 7 for recording in black, cyan, magenta, and yellow, respectively, are mounted on the carriage 8. It is then structured to obtain full color images on a recording material 2. When one line recording is completed, the recording material 2 is fed by a specific amount in the direction indicated by an arrow A (feeding direction) for the execution of image recording on the next line.

In FIG. 5, a glass (not shown) for source document use is arranged on the upper surface of the upper frame 1*b*. Images on a source document (not shown) set on this glass are read by optical sensor and others installed on the carriage 11. This reading carriage 11 reads the images on the source document set on the glass, while reciprocating in the width direction of the glass for source document use. After having read a one line portion, the reading carriage reads the next line by shifting itself by a specific amount in the longitudinal direction (which is opposite to the feeding direction A of a recording material).

The data read by the reading carriage 11 are transferred as image data from an image processing unit (not shown) to recording means 7. By these functions of the copying machine, information on a source document is recorded on a recording material 2. The recording material 2 after recording is further carried by sheet exhaust roller 13 to be exhausted onto a sheet exhaust tray 14. Here, in accordance with the fourth embodiment shown in FIG. 5, the parts of the carrying mechanism, such as the carrier roller 5 and the sheet exhaust roller 13, which are arranged on the upper side of the recording material 2, are also installed on the lower frame (recording unit) 1*a* side.

As recording means (recording head) 7, it is possible to use those means of various types. However, for the present embodiment, too, an ink jet recording means is adopted for use. Further, of those ink jet recording types, the one which discharges ink by the utilization of thermal energy is used as described in conjunction with FIG. 2. In other words, the recording head 7 is provided with electrothermal transducing elements for generating thermal energy. More precisely, this recording head discharges ink from discharge ports for the formation of images by the utilization of pressure changes generated by the development and contraction of bubbles created by film boiling caused by the thermal energy applied by means of the electrothermal transducing elements.

In FIG. 5, four ink tanks 16*a*, 16*b*, 16*c*, and 16*d* are exchangeably installed in the lower frame 1*a* to retain ink of specific colors to be supplied to each of the four colors (four pieces) of recording heads 7, respectively. As shown in FIG. 5, these ink tanks 16*a* to 16*d* are arranged in the vicinity of the left side face, which is opposite to the side where the rotational center 1*e* is provided for the lower frame 1*a*. In other words, these ink tanks are arranged on the side open to the upper frame 1*b*.

Then, the apparatus for forming images shown in FIG. 5 is structured so that when the upper frame (image reading unit) 1*b* is opened or closed with respect to the lower frame (image recording unit) 1*a*, the recording carriage 8 and the recording head 7 are suspended in a location out of the recording material carrying area on the rear portion of the apparatus main body 1. Also, the front wall 1*z* of the upper frame *b* extends to the recording unit (printer unit). Also, a part 1*y* of the left side wall of the upper frame 1*b* extends to the sheet exhaust outlet 15 of the apparatus main body 1.

Now, a description will be provided of an operation when a recording material 2 is jammed in the interior of the main body 1 of the apparatus for forming images shown in FIG. 5. When jamming occurs, the upper frame 1*b* is set at an opening position shown in FIG. 5 by rotating it around the rotational center 1*e*. Since the rotational center 1*e* is arranged in a position in the right-hand direction on the apparatus main body 1, while the front wall 1*z* and the left side wall ly extend to the recording unit (printer unit), it is possible to open the left side face evenly with respect to the recording material carrying unit of the apparatus main body 1. Also, the front side is open increasingly wider from the rotational center 1*e* toward the recording unit. In this way, the jamming disposal can be operated with ease in the two directions from the left side and the front side.

Also, since the recording head 7 and the recording carriage 8 are positioned on the rear portion of the apparatus main body 1 and on the deeper side of the recording material carrying path, there is no possibility that the recording head 7 and the recording carriage 8 may present any hindrance when carrying out jamming disposal. Particularly, it becomes easier to operate the jamming disposal in the direction indicated by an arrow G at the front. Also, the recording head 7 is located on the deeper side of the recording material carrying path, while there is no need for the operator to inserts his hand to the deep side for carrying out jamming disposal. Therefore, his hand does not touch the recording head 7 when carrying out jamming disposal. Accordingly, there is no fear that the recording head is damaged at that time.

Also, if the driving system (not shown), such as motors to drive the carrier roller 5 and exhaust roller 13, and a motor (not shown) to drive the recording carriage 8 are arranged on the deeper side 1*x* of the recording unit (printer unit), there is no possibility that the operator's hand touches these driving units while carrying out jamming disposal.

Figure 6:
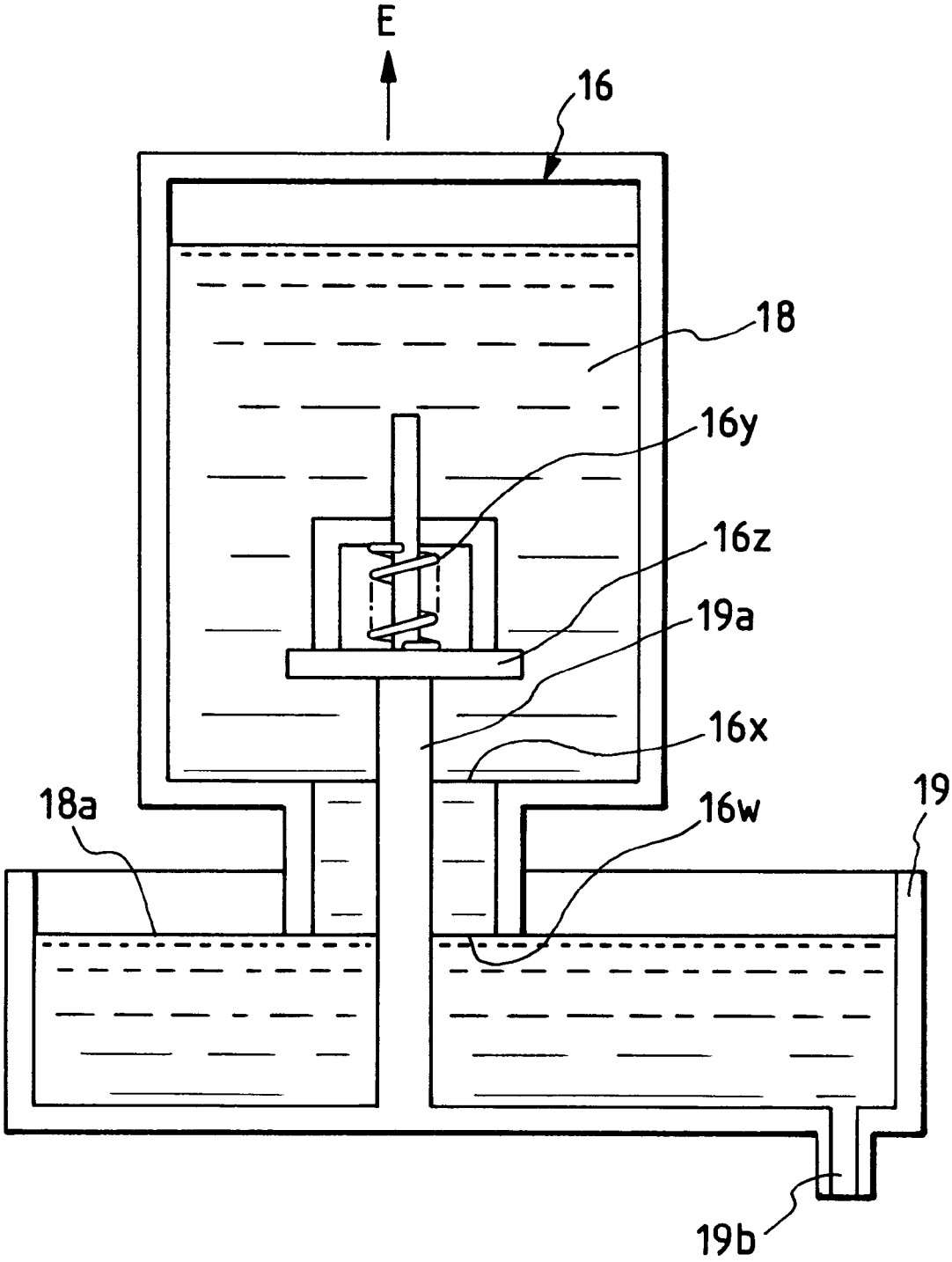
FIG. 6 is a vertical sectional view which schematically shows an ink tank unit represented in FIG. 5.

FIG. 6 is a vertical sectional view which schematically shows the interior of an ink tank 16 (arbitrarily chosen from ink tanks 16*a* to 16*d*) represented in FIG. 5. In FIG. 6, a rubber valve 16*z* is arranged in the ink tank 16 and biased downward by means of a spring 16*y* in FIG. 6. When the ink tank is in a single state, the valve 16*z* usually closes the aperture 16*x* of the ink tank. Therefore, ink 18 is retained in the ink tank 16 airtightly. As a result, ink 18 is not allowed to flow out from the ink tank 16 even if the aperture 16*x* of the ink tank is placed downward in FIG. 6.

Also, a main tank 19 is arranged on the apparatus main body 1. A pin 19*a* is provided for the main tank 19. Also, an aperture 19*b* is arranged at the lower part of the main tank 19 to carry ink 18 to the recording head 7.

With the structure described above, the pin 19*a* pushed up the valve 16*z* when the ink tank 16 is mounted on the main tank 19, thus opening the aperture 16*x* of the ink tank. In this way, ink 18 in the ink tank 16 flows out to the main tank 19. However, the flowing out of ink 18 in the ink tank 16 stops when the upper surface 18*a* of ink in the main tank 19 arrives at the end face 16*w* of the aperture of the ink tank 16. Thereafter, whenever ink 18 is consumed to lower the upper surface 18*a* of ink, ink 18 in the ink tank 16 flows out until the upper surface 18*a* of ink reaches the end face 16*w* of the ink tank aperture (hereinafter, a supply mechanism of the kind is referred to as a chicken feed system). An ink tank of the chicken feed system can be structured simply at lower costs, thus providing an effective means for exchanging ink tanks. As clear from FIG. 6, it is most effective to draw out the ink tank of the chicken feed system in the direction indicated by an arrow E when the ink tanks 16 are exchanged. Therefore, in accordance with the present embodiment, the ink tanks 16*a* to 16*d* are arranged in the vicinity of the aperture on the left side of the apparatus main body 1. Since a sufficient space is formed above these ink tanks, it is easier to mount or demount each of the color ink tanks 16*a* to 16*d* in the direction indicated by an arrow E in order to exchange each of them. Also, there is an advantage that any particular aperture, member to cover such aperture, or the like is not needed for exchanging ink tanks.

Also, in accordance with the fourth embodiment shown in FIG. 5, a space is secured above the stop position of the recording head 7. Therefore, if any one of recording heads 7 should be exchanged at the time of executing maintenance or the like, it is easier to demount or mount such recording head in the direction indicated by an arrow F.

Here, in accordance with the fourth embodiment shown in FIG. 5, when a plurality of heads are mounted, the recording heads on the inner side cannot be exchanged easily if it is intended to demount or mount the recording heads 7 in the directions indicated by arrows G and G'. Also, if it is intended to demount or mount the recording heads 7 in the directions indicated by arrows H and H', there are ink tanks 16*a* to 16*d* arranged to stand in its way. Also, the direction indicated by an arrow H' is the direction in which the rotational center 1*e* is arranged. Therefore, the opening between the image reading unit (upper frame) 1*b* and the image recording unit (lower frame) 1*a* becomes increasingly narrower. Consequently, it becomes difficult to secure a sufficient space for carrying out operations required in this respect. Taking these aspects into account, it is most effective to demount and mount the recording heads in the direction indicated by an arrow F in FIG. 5.

Also, ink tanks 16*a* to 16*d* are exchanged when ink is completely consumed. Usually, therefore, the operator who uses the apparatus himself exchanges them. On the other hand, the recording heads 7 are exchanged by a skilled worker who has a knowledge of how to exchange them, because not only its frequency is less than that of ink tank exchanges, but also, the electrical connections and the engagement of ink paths should be made, among some other routines required. With these aspects in view, the ink tanks 16*a* to 16*d* are arranged in a location farthest from the rotational center 1*e* to obtain the widest working space. In the meantime, since the recording heads are exchanged by a skilled worker, a working space may be a little narrower. Therefore, the recording heads can be arranged in a location nearer to the rotational center 1*e* than the ink tanks 16*a* to 16*d*.

Also, in order to decrease the frequency of exchanges of ink tanks, it is necessary to increase the amount of ink in each ink tank. As a result, the ink tanks should be made larger. On the other hand, the recording head 7 is of a serial recording type whose recording width is several tens of mm (for one scan in the sheet feeding direction) as in the present embodiment. The head is not very large. Therefore, in accordance with the present embodiment, it is possible to effectively select a position farthest from the rotational center 1*e* for the location of the larger ink tanks for performing its exchanges easier.

Also, in FIG. 5, the recording unit (lower frame) 1*a* and the reading unit (upper frame) 1*b* are open at an angle far smaller than 90 degrees. This is because if the opening angle of the reading unit 1*b* is almost 90 degrees or more than 90 degrees, the center of gravity of the entire body shifts to a higher position and the stability of the apparatus is inevitably lowered as a whole. Further, it will suffice if only the opening angle of the reading unit 1*b* can provide an angle good enough to carry out the jamming disposal and to exchange the ink tanks. Here, there is no need for making such an angle larger.

With the structure described above, the recording head 7 is located near the rotational center 1*e*. As a result, it may be difficult to secure a sufficient space for exchanging the recording heads in some cases. However, from the viewpoint that the recording heads 7 are exchanged by a skilled worker, it may be possible to arrange the structure so as to open the reading unit 1*b* much wider by releasing locking means (not shown). With the adoption of such a structure, it is possible to secure a sufficient space for exchanging recording heads.

Figure 7:
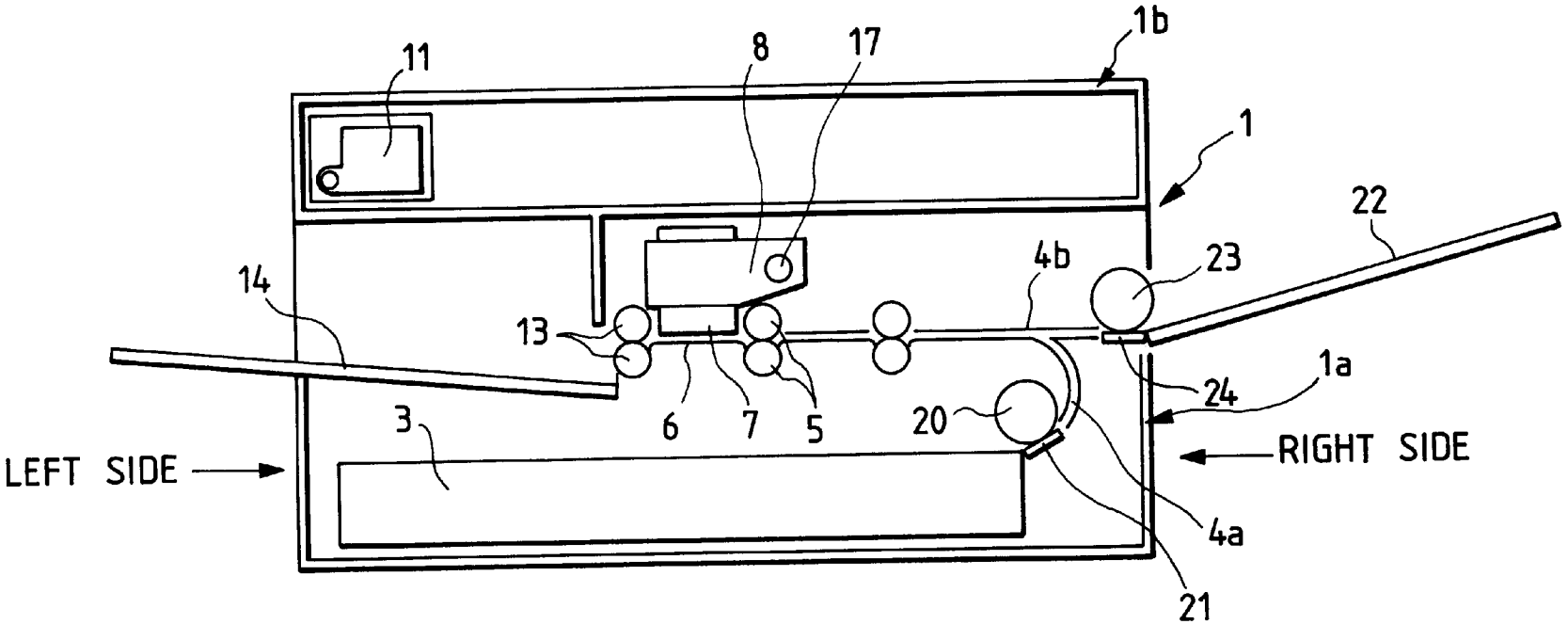
FIG. 7 is a vertical sectional view which schematically shows a state where the upper frame is closed for the apparatus for forming images represented in FIG. 5.

FIG. 7 is a vertical sectional view showing a state that the upper frame is closed in the apparatus for forming images shown in FIG. 5 is closed. In FIG. 7, by means of a sheet feed roller 20 and a separation pad 21, only a recording material 2 on the top of those stacked in the cassette 3 is fed into a U-turn guide 4*a*, and then, carried to a first carrier roller 5 through the roller pairs arranged on the downstream thereof. The U-turn guide 4*a* enables a turn over of approximately 180 degrees. However, with such arrangement of sheet feeding from the cassette 3, it is difficult to feed a thick recording material, because the recording material 2 should pass the U-turn guide 4*a*.

Therefore, in accordance with the present embodiment, it is structured to provide a sheet feed tray 22, a second sheet feed roller 23 and a second separation pad 24 on the right side of the apparatus main body 1, and to feed a recording material on the sheet feed tray 22 to a horizontal guide 4*b* arranged to be substantially horizontal, thus feeding it to the carrier roller 5 through the roller pair on the downstream side thereof. With the arrangement of a substantially horizontal carrier path from the sheet feed tray 22 to the carrier roller 5 by way of the horizontal guide 4*b*, it is easy to feed a thick recording material (recording sheet or the like). Also, the sheet feed tray 22 is arranged on the right side of the apparatus main body 1, while the sheet exhaust tray 14 is arranged on the left side of the apparatus main body 1. Therefore, there is no extrusion on the front of the apparatus that may present any obstacle when placing a source document on the reading unit 1*b*.

Figure 8:
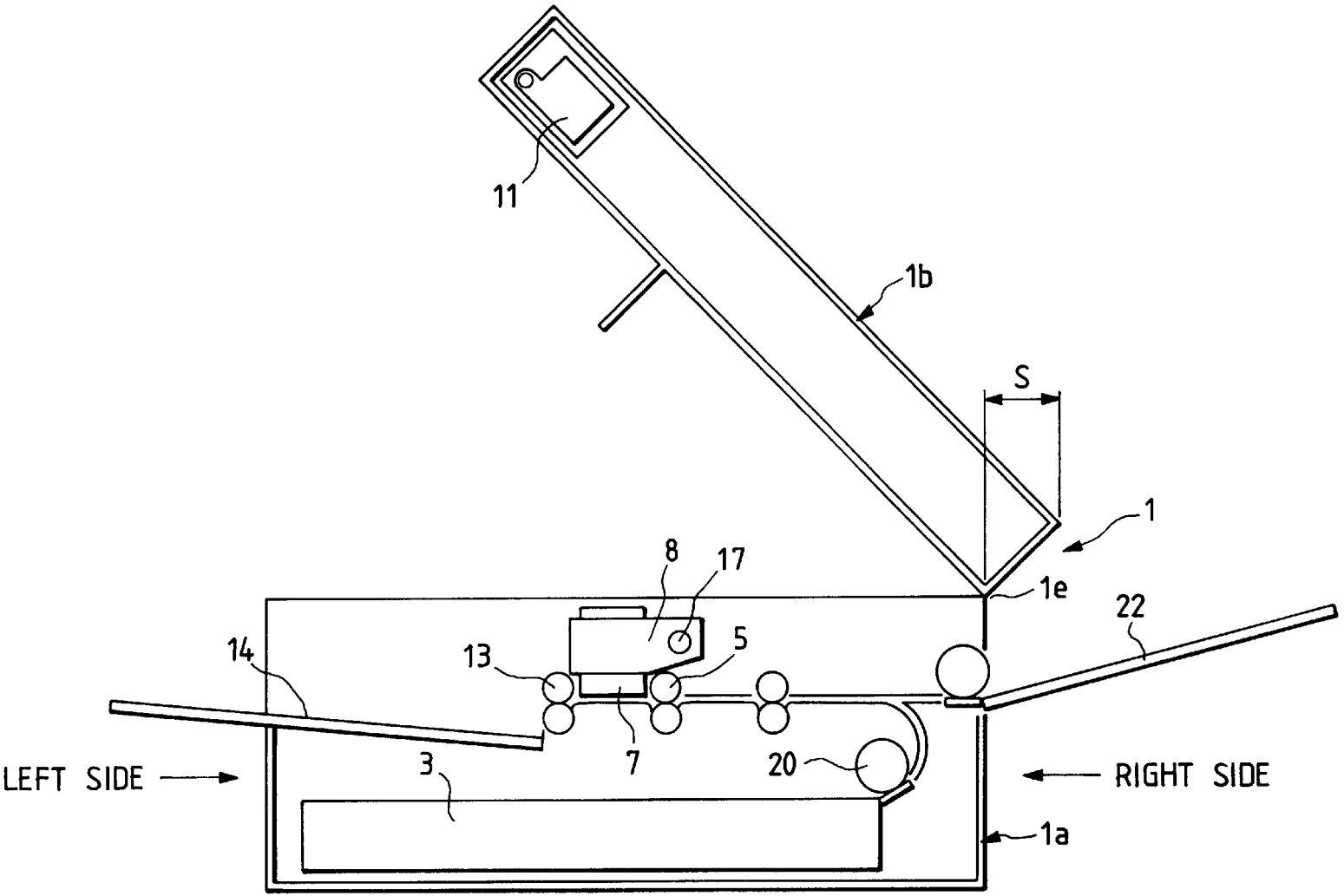
FIG. 8 is a vertical sectional view which schematically shows a state where the upper frame is opened for the apparatus for forming images represented in FIG. 5.

FIG. 8 is a vertically sectional view which shows a state that the upper frame (reading unit) 1*b* of the apparatus for forming images represented in FIG. 7 is open. In order to widen the aperture formed by the reading unit 1*b* in FIG. 8, it is necessary to locate the rotational center 1*e* near the right end of the apparatus as shown in FIG. 8. Then, the end portion of the apparatus protrudes from the right side of the apparatus by a distance s when the reading unit 1*b* is open. However, in accordance with the present embodiment, the sheet feed tray 22 is installed, while the amount of protrusion of the reading unit 1*b* is smaller than the length of the sheet feed tray 22. As a result, even if the right side of the apparatus is placed near the wall at the time of installation, there is no possibility that the right end portion of the apparatus is in contact with the wall when the reading unit 1*b* is open.

Also, if an article (such as a source document) is placed on the reading unit 1*b* and the reading unit should be opened without removing it, such article drops onto the upper surface of the sheet feed tray 22 or a space formed below the sheet feed tray by means of the apparatus thus installed. There is no fear that the source document or other article drops into the narrow gap between the apparatus and the wall or the like.

Also, the weight of the recording carriage 8 should be made as light as possible in order to attain a higher recording speed. The present embodiment is advantageous in this aspect, because the structure is arranged so as not to mount the weighty ink tanks 16*a* to 16*d* on the recording carriage 8. Particularly, in consideration of the fact that the amount of ink consumption per hour should increase more at a higher recording, and that the ink tanks 16*a* to 16*d* should be made larger in order to reduce the frequency of its exchange, the present embodiment, in which no ink tanks are mounted on the recording carriage, is extremely advantageous in attaining the higher speed recording, which has been more in demand in recent years.

Figure 9:
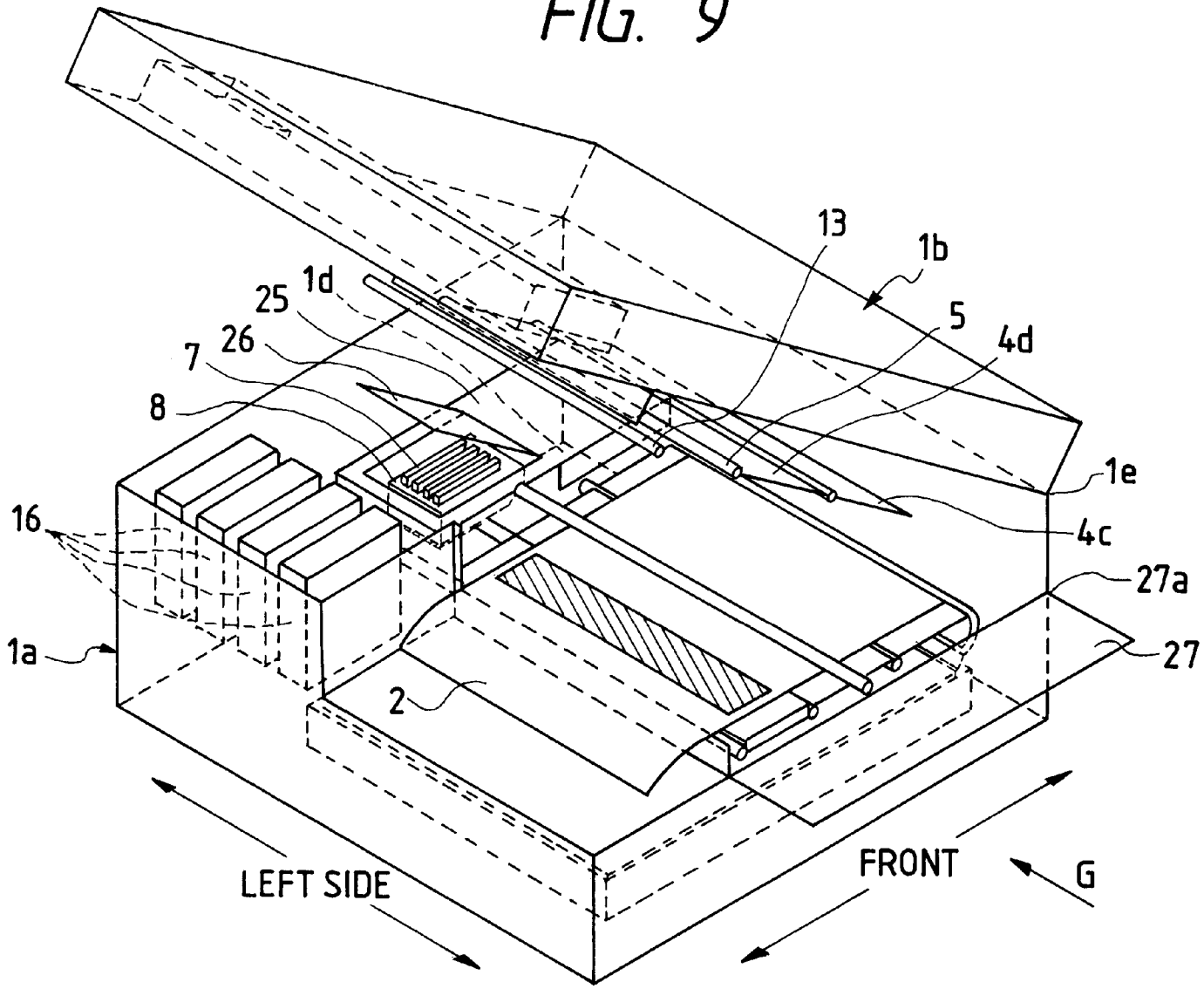
FIG. 9 is a perspective view which schematically shows an apparatus for forming images in accordance with a fifth embodiment as an embodiment to which the present invention is applicable.

FIG. 9 is a perspective view which schematically shows an apparatus for forming images in accordance with a fifth embodiment to which the present invention is applicable. In accordance with the present embodiment, those aspects described below differ from the fourth embodiment represented in FIG. 5 to FIG. 8. All other structures are substantially the same as those of the fourth embodiment. Therefore, the same reference mark is applied to the parts shared by both embodiments, and a detailed description thereof will be omitted.

At first, a front cover 27 is arranged on the front face of the apparatus in accordance with the present embodiment. The front cover 27 is provided with a rotational center 27*a* in parallel to the feeding direction of a recording material 2, and installed to be open in the forward direction with respect to the apparatus. With the structure described above, it is possible to secure a wider opening area than the fourth embodiment represented in FIG. 5 to FIG. 8 for carrying out jamming disposal in the direction indicated by an arrow G.

Also, in accordance with the present embodiment, there are installed on the reading unit (upper frame) 1*b* side the guides, rollers and others constituting the carrying mechanism, such as carrier guides 4*c* and 4*d*, carrier roller 5, sheet exhaust roller 13, which are arranged on the upper side of a recording material at the time of carrying a recording material. Then, the structure is arranged to enable these constituents to part from the recording material 2 together with the reading unit 1*b* when the reading unit is opened. In this way, when a jammed recording material should be removed, it becomes easier to operate the jamming disposal of the recording material.

Further, for the present embodiment, a cover 25 is arranged above the stop position of the recording carriage 8. Therefore, with the reading unit 1*b* being open, the recording carriage 8, the recording head 7, and a driving unit (not shown, but arranged on the rear portion at 1*d* of the recording unit 1*a*) are still covered by means of the cover 25, thus eliminating the fear that the operator touches these parts to cause any malfunction thereof. Also, a lid 26 that can be opened and closed is arranged for the cover 25 in a position above the recording head 7. Then, it is made possible to exchange recording heads 7 by opening this lid.

Figure 10:
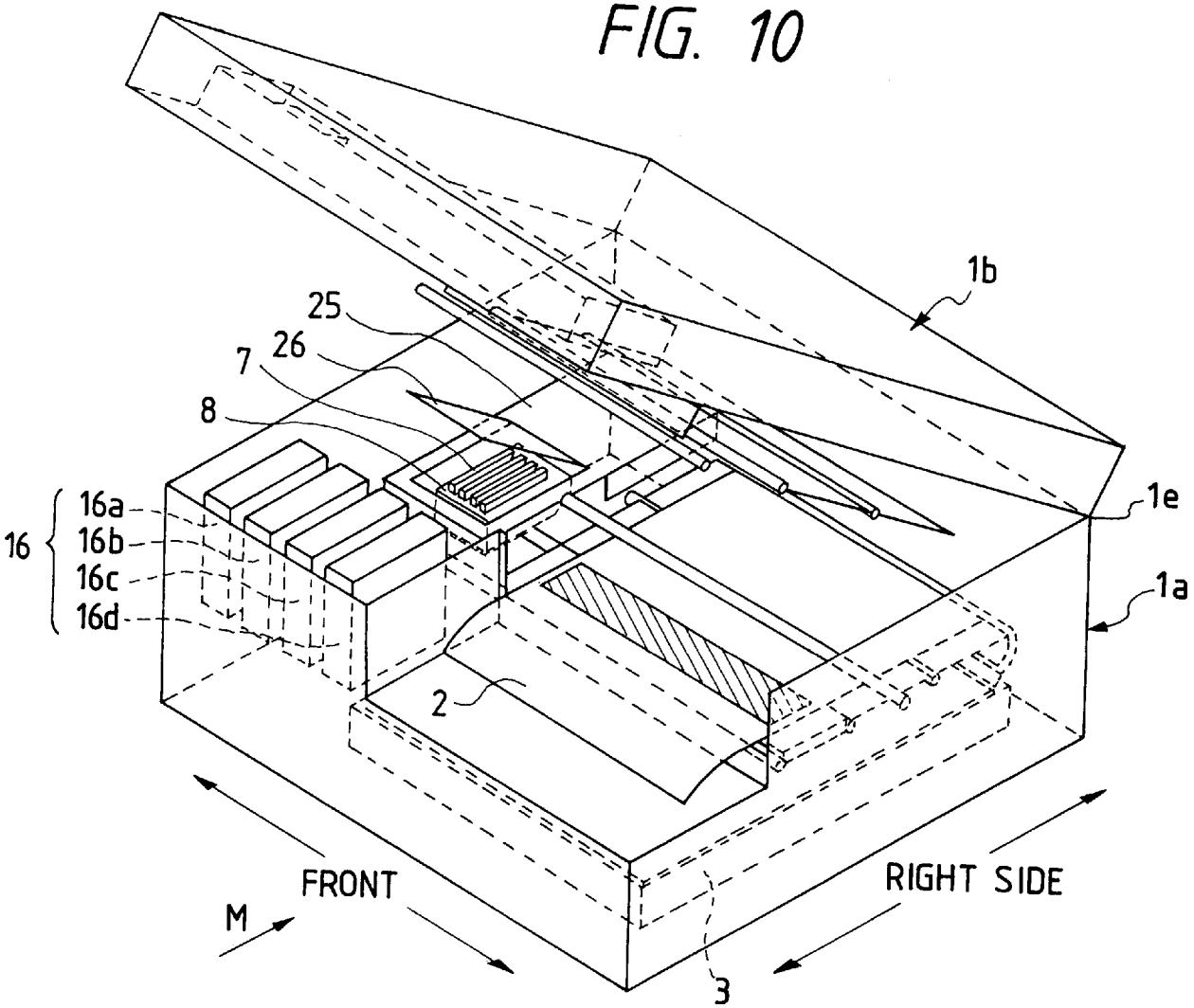
FIG. 10 is a perspective view which schematically shows an apparatus for forming images in accordance with a sixth embodiment as an embodiment to which the present invention is applicable.

FIG. 10 is a perspective view which schematically shows an apparatus for forming images in accordance with a sixth embodiment to which the present invention is applicable. In accordance with the present embodiment, the sheet exhaust side of the fifth embodiment represented in FIG. 9 is modified so that this side is brought to the front side of the apparatus. The aspects described below differ from those of the fifth embodiment represented in FIG. 9. In accordance with the present embodiment, the structure is arranged so as to avoid the provision of the front cover 27 shown in FIG. 9. For the present embodiment, the sheet feed tray 22, the second sheet feeding roller 23 and the second separation pad 24 provided for the fourth embodiment represented in FIG. 7 are not provided, either.

In accordance with the sixth embodiment shown in FIG. 10, the cassette 3 can be demounted and mounted from the front side of the apparatus in the direction indicated by an arrow M. The sheet exhausting is also performed at the front side. Therefore, on the left and right side faces, and the rear face of the apparatus, there are no parts arranged for any operation at all. As a result, the left and right side faces, and the rear face of the apparatus may be placed against the wall, hence making it possible to reduce the floor space needed for the installation thereof. Also, the ink tanks 16*a* to 16*d* are arranged forward more than the recording head 7 in a location where the aperture formed by the reading unit 1*b* should become the widest. Therefore, it is easier to exchange each of the ink tanks. Also, unlike the fourth and fifth embodiments, each of the color ink tanks is all arranged on the front side of the apparatus. There is no difference in the exchangeability of any one of the ink tanks due to its arrangement order. In other words, for the fourth and fifth embodiments described earlier, it is more difficult to exchange the ink tanks located on the deeper side than the one on the front side. By such arrangement adopted for the present embodiment, it is possible to eliminate a situation of this kind.

Figure 11:
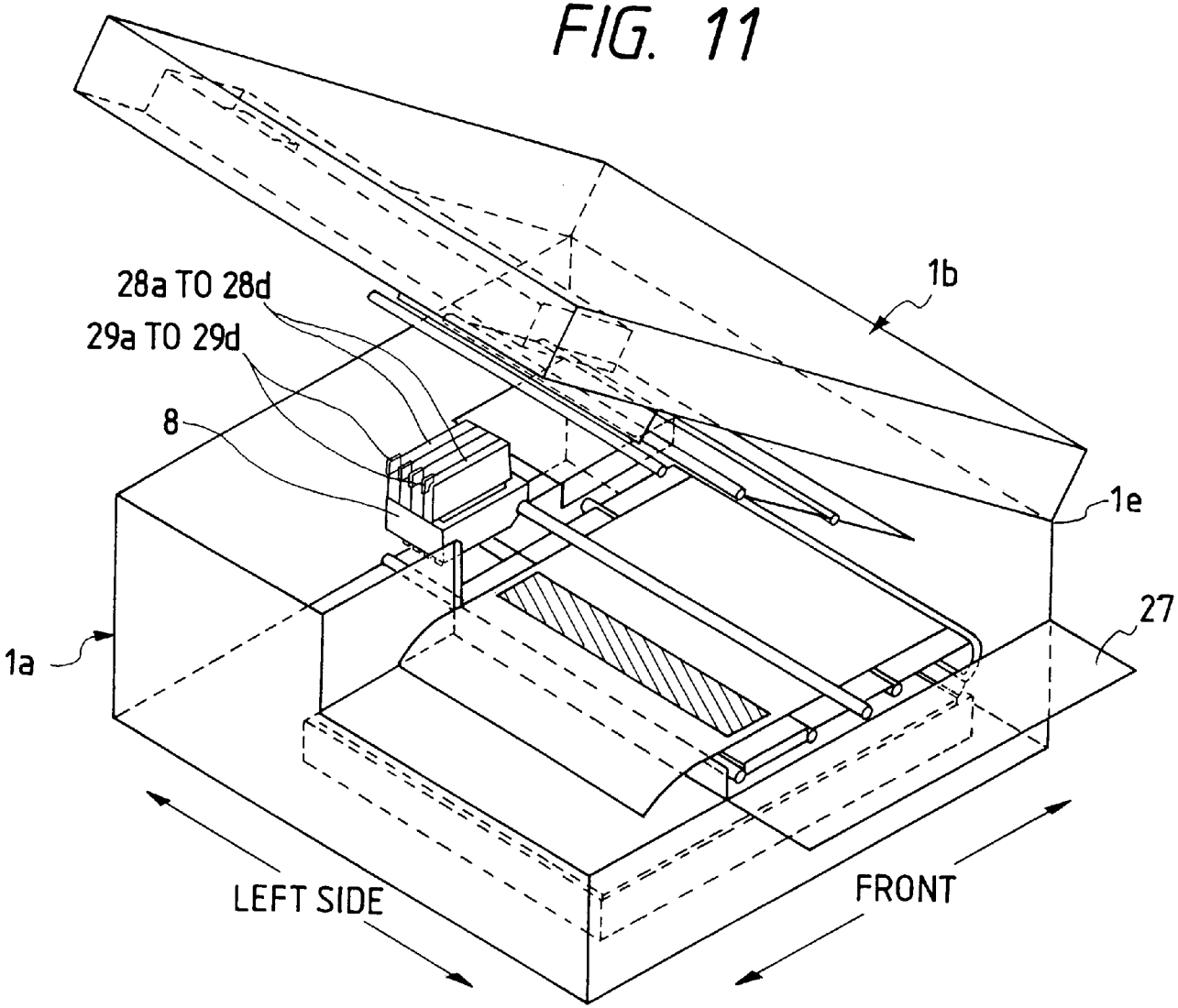
FIG. 11 is a perspective view which schematically shows an apparatus for forming images in accordance with a seventh embodiment as an embodiment to which the present invention is applicable.

FIG. 11 is a perspective view which schematically shows an apparatus for forming images in accordance with a seventh embodiment to which the present invention is applicable. For the present embodiment, the aspects described below differ from the fifth embodiment represented in FIG. 9. All other aspects are substantially the same as those of the fifth embodiment. Therefore, each of the parts shared by the embodiments is designated by the same reference mark, and a detailed description thereof will be omitted.

In FIG. 11, four pieces of ink tanks 28*a*, 28*b*, 28*c*, and 28*d* each retaining a specific color ink to be supplied to the four colors (four pieces) of recording heads 7, respectively, are mounted on a recording carriage 8. In other words, the ink tanks 28*a* to 28*d* are structured to be exchangeable separately from the corresponding recording heads 7, or to be exchangeable together with each of the corresponding recording heads 7. All the other structures of the present embodiment is essentially the same as those of the fifth embodiment represented in FIG. 9.

In accordance with the present embodiment, the ink tanks 28*a* to 28*d* are mounted on the recording carriage 8. Therefore, it is unnecessary to provide any pump, supply tube, and the like for supplying ink from the ink tanks to each of the recording heads 7, which contributes to reducing the costs of manufacture significantly. With the structure shown in FIG. 11, the operativity (effects) of the jamming disposal is the same as that of the fifth embodiment represented in FIG. 9.

Also, knobs 29*a,* 29*b,* 29*c,* and 29*d* are arranged on the respective portions on the side opposite to the rotational center of each of the ink tanks 28*a* to 28*d.* Each of the ink tanks 28*a* to 28*d* is exchanged by handling each of these knobs. In this way, it is possible to exchange each of the ink tanks 28*a* to 28*d* with ease from the wider aperture side, which is opposite to the side where each rotational center 1*e* is located.

In the fourth to seventh embodiments shown in FIG. 5 to FIG. 11, the rotational center 1*e* is arranged on the side where the U-turn guide from the cassette 3 is provided, but it may be possible to arrange the rotational center 1*e* on the sheet exhaust side, which is opposite to the side where the U-turn guide 4*a* is provided, and at the same time, to arrange the ink tanks 16*a* to 16*d* on the U-turn guide 4*a* side. With a structure such as this, it is possible to attain the same effects obtainable by each of the embodiments described earlier.

In accordance with the fourth to seventh embodiments described above, when a recording material 2 is jammed in the apparatus main body 1, a sufficient space is obtainable for the execution of jamming disposal. Therefore, it is possible to provide an apparatus for forming images capable of carrying out jamming disposal easily, and to substantially eliminate the possibility that the operator touches the recording heads 7 by his hand when he carries out the jamming disposal. Therefore, there is no fear to get the adjusted position of each recording head out of order. Further, an ink jet recording apparatus having a plurality of ink tanks mounted on it to retain ink can be provided as an apparatus for forming images that makes it possible to exchange ink tanks easily.

Figure 12:
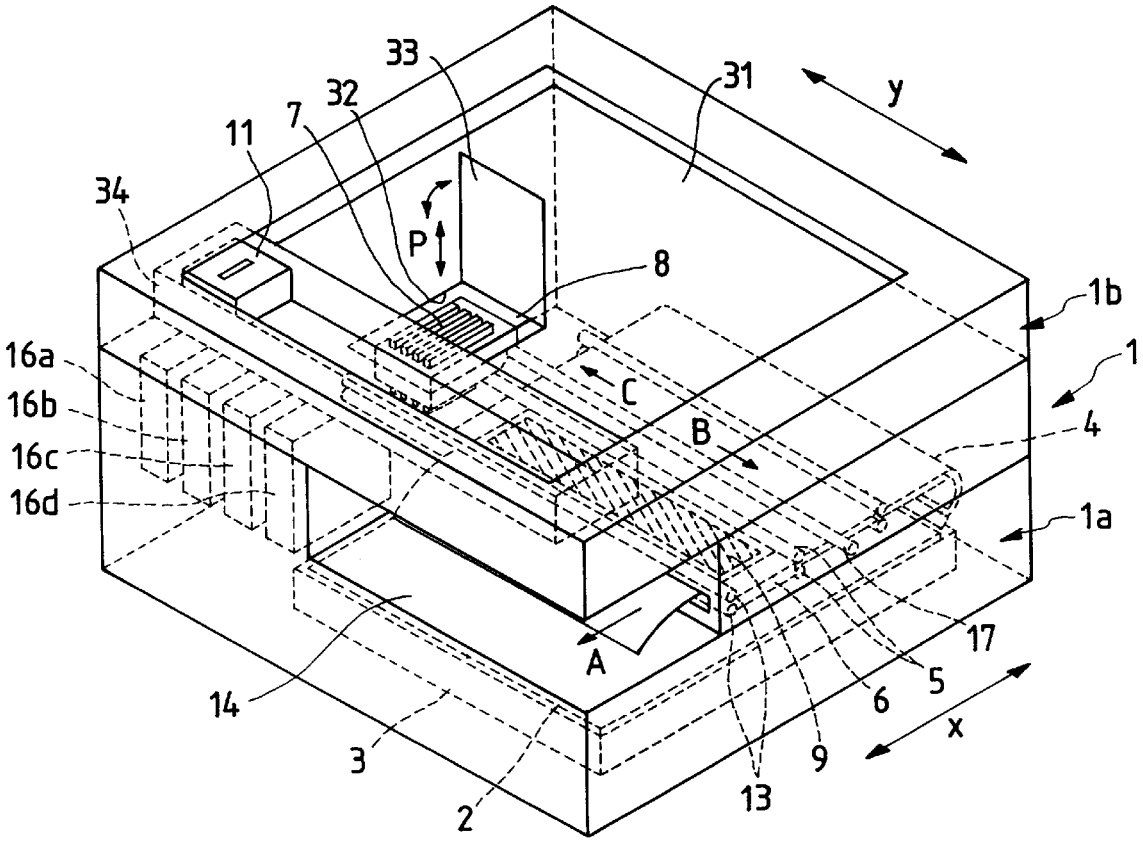
FIG. 12 is a perspective view which schematically shows an apparatus for forming images in accordance with an eighth embodiment as an embodiment to which the present invention is applicable.
Figure 13:
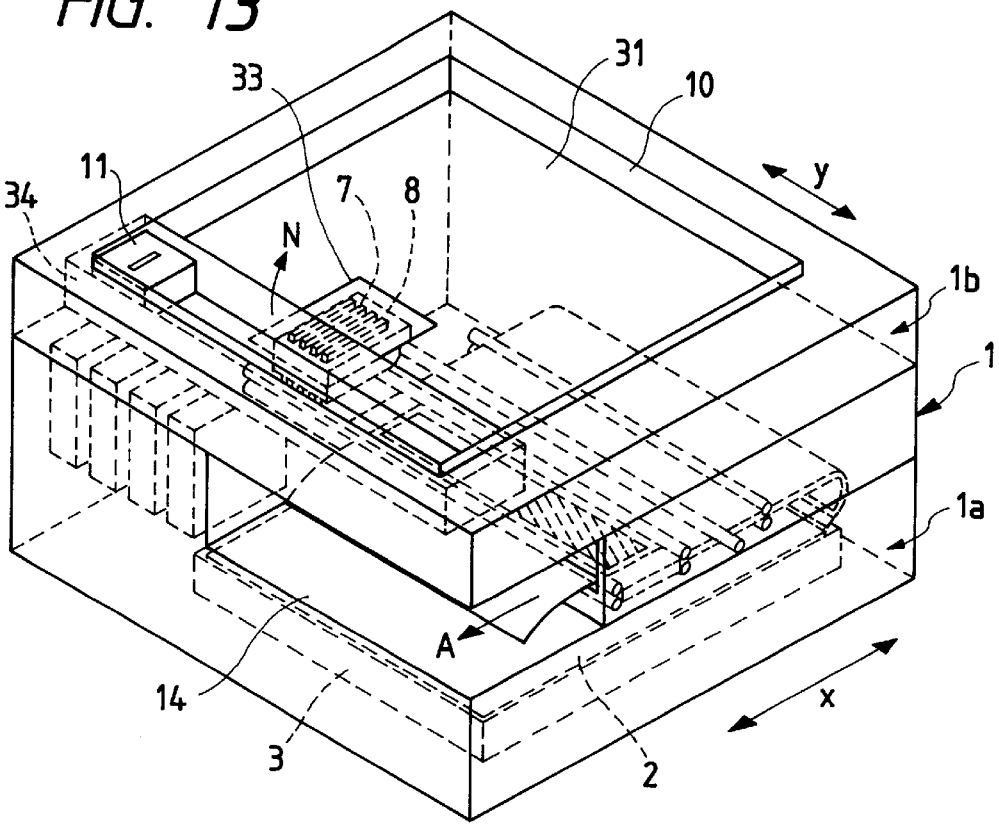
FIG. 13 is a perspective view which schematically shows a state where the cover of the apparatus for forming images represented in FIG. 12 is closed and a glass for a source document is installed.

FIG. 12 is a perspective view which schematically shows a state where a glass for source document use is removed and a lid is open for an apparatus in accordance with an eighth embodiment to which the present invention is applicable. FIG. 13 is a perspective view which schematically shows a state that the lid is closed for the apparatus for forming images represented in FIG. 12. The present embodiment also represents a case where an apparatus for forming images is an ink jet recording apparatus provided with the functions of a copying machine. In FIG. 12 and FIG. 13, the apparatus main body 1 comprises a lower frame la having an image recording unit incorporated in it, and an upper frame 1*b* having an image reading unit incorporated in it.

In the lower frame 1*a,* a cassette 3 is incorporated to stack plural sheets of recording material 2. In the cassette 3, a recording material 2 on the top of the stack is separated by sheet feeding means (not shown), and supplied to a first carrier roller 5 through a guide 4, and then, carried to and suspended at the recording start position on a platen 6 by means of the carrier roller 5. Here, the recording carriage 8 having recording means (recording head) 7 mounted thereon travels in the directions indicated by an arrow B and an arrow C along a guide shaft 17, thus recording images by recording means 7 on the image formation area (one line portion) 9 of the recording material 2 indicated by slanted lines.

The guide shaft 17, the recording carriage 8, and the recording head (recording means) 7 are installed on the lower frame (image recording unit) 1*a* side. Also, in accordance with the present embodiment, four recording heads 7 for recording in black, cyan, magenta, and yellow, respectively, are mounted on the carriage 8. It is then structured to obtain full color images on a recording material 2. When one line recording is completed, the recording material 2 is fed by a specific amount in the direction indicated by an arrow A (feeding direction) for the execution of image recording on the next line.

In FIG. 13, a glass 10 for source document use is arranged on the upper surface of the upper frame 1*b*. Images on a source document (not shown) set on this glass 10 are read by optical sensor and others installed on the carriage 11. This reading carriage 11 reads the images on the source document, while reciprocating in the width direction of the source document. After having read a one line portion, the reading carriage reads the next line by shifting itself by a specific amount in the longitudinal direction (which is opposite to the feeding direction A of a recording material).

The data read by the reading carriage 11 are transferred as image data from an image processing unit (not shown) to recording means 7. By these function of the copying machine, information on a source document is recorded on a recording material 2. The recording material 2 after such recording is further carried by sheet exhaust roller 13 to be exhausted onto a sheet exhaust tray 14.

As recording means (recording head) 7, it is possible to use those means of various types. However, for the present invention, too, ink jet recording means is adopted for use. Further, of those ink jet recording types, the one which discharges ink by the utilization of thermal energy is used as described in conjunction with FIG. 2. In other words, the recording head 7 is provided with electrothermal transducing elements for generating thermal energy. More precisely, this recording head discharges ink from discharge ports for the formation of images by the utilization of pressure changes generated by the development and contraction of bubbles created by film boiling caused by the thermal energy applied by means of the electrothermal transducing elements.

In FIG. 12 and FIG. 13, a partitioning member 31 is arranged between the upper frame 1*b* and the lower frame 1*a*. On the partitioning member 31, an aperture is provided above the stop position of the recording carriage 8, and a lid 33 is arranged to be freely opened and closed centering on its one end in order to cover this aperture 32.

At first, a description will be provided of a method for exchanging recording heads 7 in the structure described above. FIG. 13 is a view which shows the state of an apparatus for forming images in use (at the time of suspension) in accordance with the present embodiment. When the recording heads 7 are exchanged, the glass 10 for source document use is removed, at first. Then the lid 33 is caused to rotate in the direction indicated by an arrow N to open the aperture 32 to bring it to be in a state shown in FIG.

12. At this juncture, a second reading carriage 34 of the image reading unit 1*b* stops at the left end side where no obstacles are present with respect to the opening and closing of the lid 33. In this state, it is possible for the operator to insert his hand or his tool to draw out the recording head 7 in the direction indicated by an arrow P. Likewise, he can also mount the recording head 7 on the recording carriage 8 through the aperture 32 in the direction indicated by the arrow P.

Figure 14:
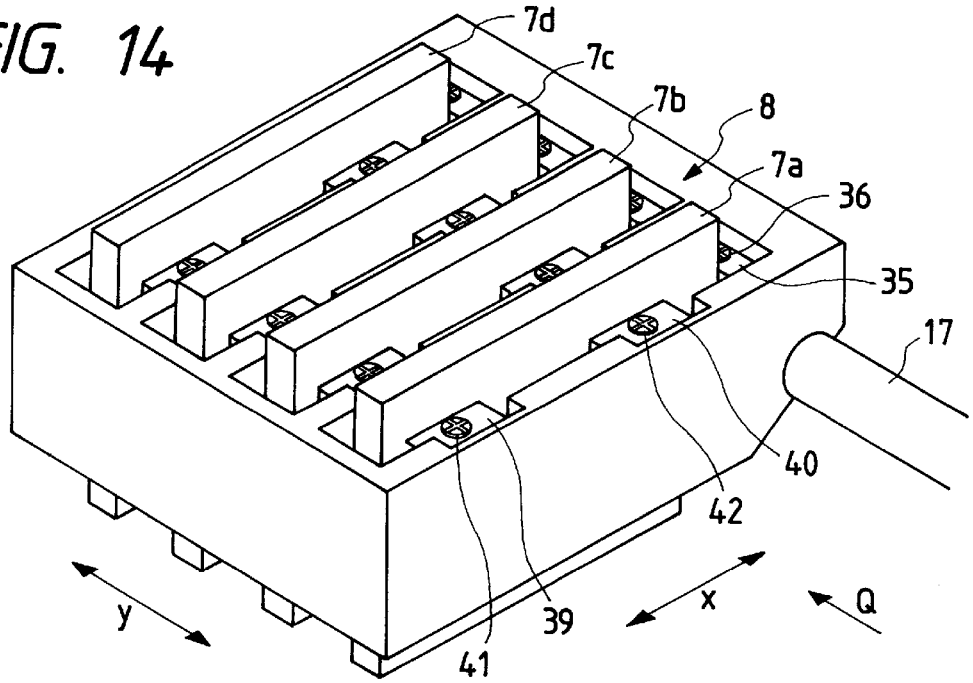
FIG. 14 is a perspective view which shows the structure of the recording carriage represented in FIG. 12.
Figure 15:
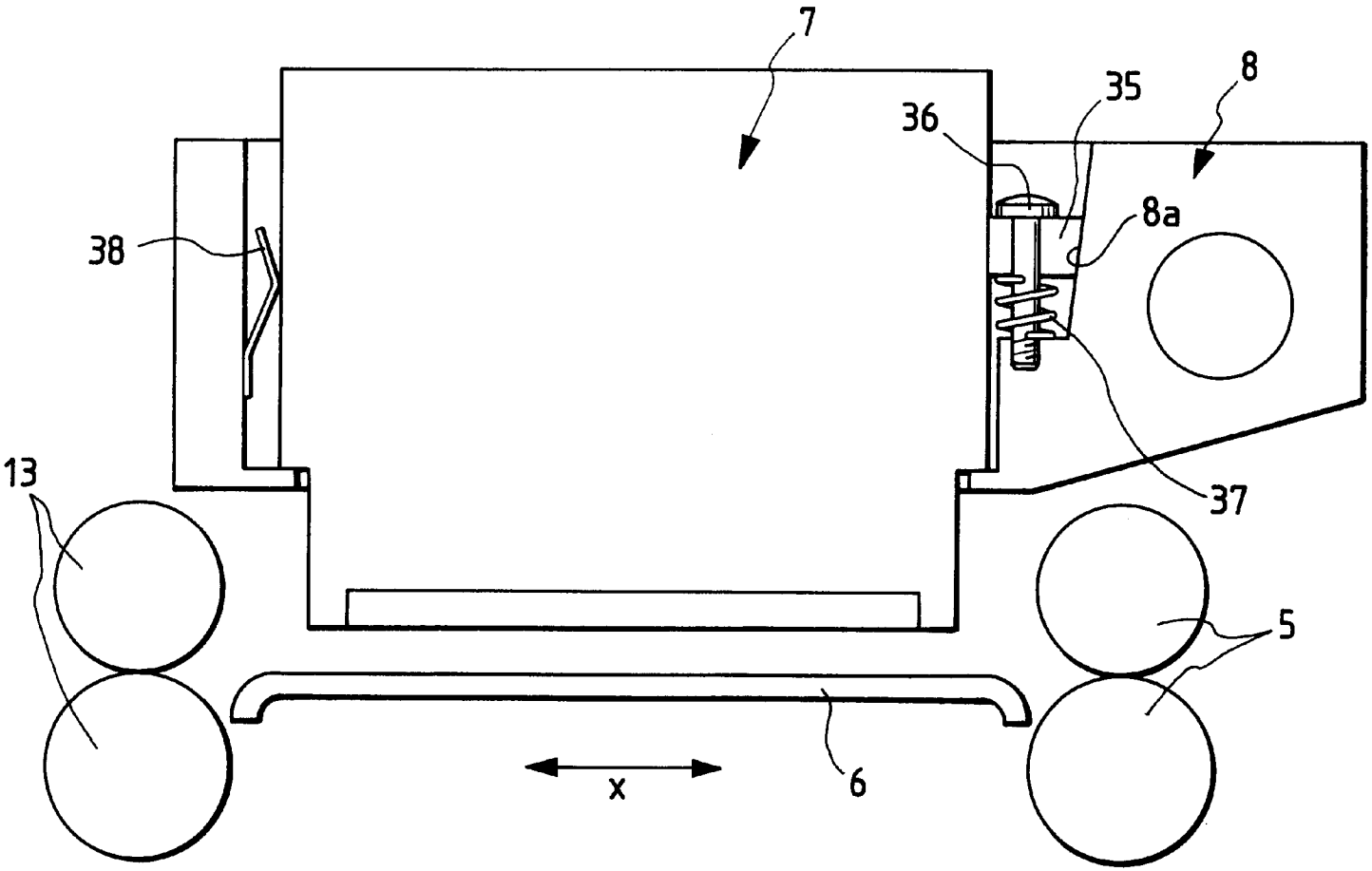
FIG. 15 is a cross-sectional view which shows the recording carriage and recording means observed in the direction indicated by an arrow Q in FIG. 14.

Now, a description will be provided of the positional adjustment of the recording heads 7. In FIG. 14, black, magenta, cyan, and yellow recording heads 7*a,* 7*b,* 7*c,* and 7*d* are mounted on the recording carriage 8. FIG. 15 is a cross-sectional view which shows the recording carriage and recording head, observed in the direction indicated by an arrow Q in FIG. 14.

At first, with reference to FIG. 14 and FIG. 15, the description will be provided of the positional adjustment of the recording heads 7 in the direction x. In FIG. 14 and FIG. 15, an adjustment block 35, an adjustment screw 36, and an adjustment spring 37 are arranged on the right side of the recording carriage 8. The adjustment block 35 can move up and down by the rotation of the adjustment screw 36. Also, on the left side of the recording carriage 8, a pressure spring 38 is provided to press the right side of the recording head 7 to the adjustment block 35. Also, the surface 8*a* of the recording carriage 8, which is in contact with the adjustment block 35, is inclined, thus making it possible to carry out the positional adjustment of the recording head 7 in the direction x by rotating the adjustment screw 36.

Now, with reference to FIG. 14, a description will be provided of the positional adjustment of the recording head 7 in the direction y. In FIG. 14, the recording carriage 8 is provided with two adjustment blocks 39 and 40 and two adjustment screws 41 and 42 for each of the recording heads for use of adjusting the recording heads 7 in the direction y. Further, each of the recording heads 7 is provided with two adjustment springs (not shown) and pressure springs (not shown) corresponding to the two adjustment blocks 39 and 40 as in the positional adjustment in the direction x.

Figure 16:
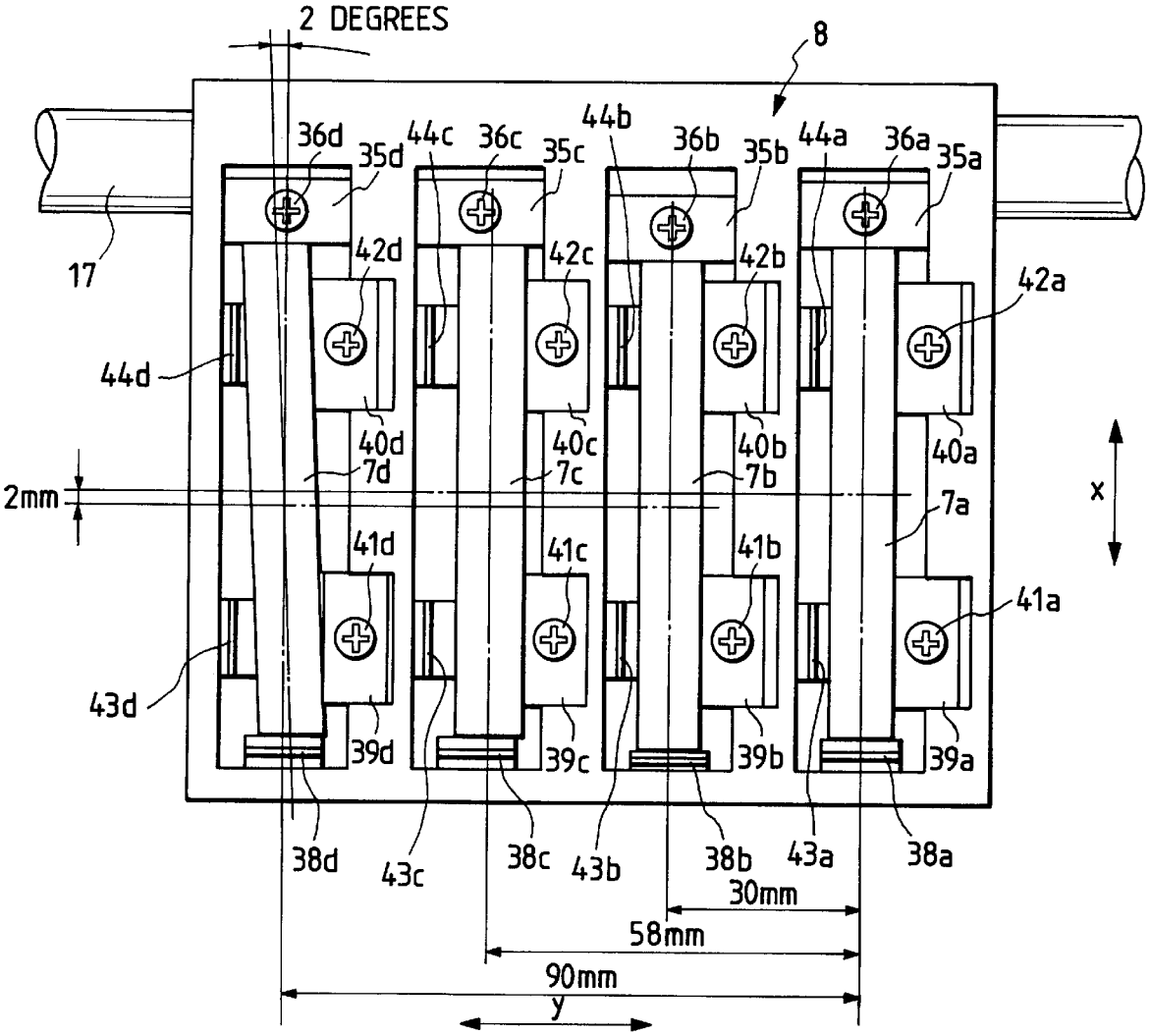
FIG. 16 is a plan view which shows the structure of the recording carriage represented in FIG. 14.

FIG. 16 is a plan view which shows the structure of the recording carriage 8. In FIG. 16, the adjustment blocks 39*a* to 39*d,* 40*a* to 40*d,* and 35*a* to 35*d,* and the adjustment screws 41*a* to 41*d,* 42*a* to 42*d,* and 36*a* to 36*d,* and the pressure springs 38*a* to 38*d,* 43*a* to 43*d,* and 44*a* to 44*d* are shown with respect to the black recording head 7*a,* magenta recording head 7*b,* cyan recording head 7*c,* and yellow recording head 7*d,* respectively.

In FIG. 16, the head pitches in the direction y is 30 mm each. In the direction x, an appropriate position is such that each center of the recording heads becomes identical. Here, regarding the black recording head 7*a* as reference, the magenta recording head 7*b* is displaced by 2 mm in the direction x. This adjustment is carried out by rotating the adjustment screw 36*b* to raise the adjustment block 35*b* accordingly.

Also, the cyan recording head 7*c* is displaced by 2 mm in the direction y. This adjustment is carried out by lowering the adjustment blocks 39*c* and 40*c* by rotating the adjustment screws 41*c* and 42*c* accordingly. Also, the central position of the yellow recording head 7*d* is correct, but it rotates only two times. This is possible by lowering the adjustment block 39*d* while raising the adjustment block 40*d* by rotating the adjustment screws 41*d* and 42*d* accordingly.

With the adjustments described above, the positions of the recording heads 7*a* to 7*d* of four colors (four pieces) are properly adjusted. In accordance with the present embodiment, it is exemplified to show an amount of adjustment as large as 2 mm. However, in order to perform recording in the best condition, the amount of positional adjustment required is approximately 0.005 to 0.03 mm for the four colors (four pieces) recording heads 7*a* to 7*d* (depending on the performance of such recording heads). Therefore, a highly precise adjustment is needed for each of them eventually.

Particularly, when the recording heads 7 are exchanged, the positional adjustment of the recording heads 7 is one of the necessary operations. However, in accordance with the present embodiment, such adjustment can be made just by rotating the adjustment screws 41, 42, and 36 from above the recording carriage 8 by use of a screw driver. Not only for exchanging the recording heads 7, but if any misregistration should take place with respect to the positions of recorded images while using the apparatus, it is possible to carry out the positional adjustment of the recording heads 7 easily just by opening the lid 33 after having removed the glass 10 for source document use.

Figure 17:
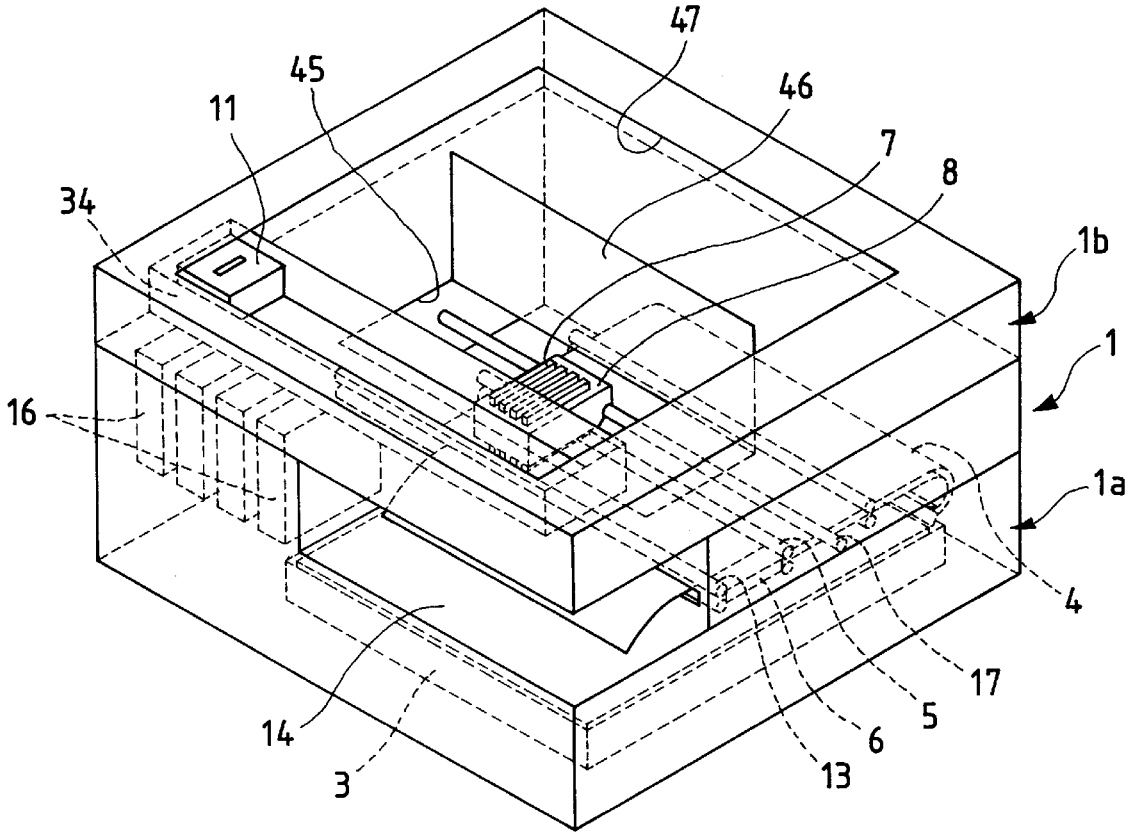
FIG. 17 is a perspective view which schematically shows an apparatus for forming images in accordance with a ninth embodiment as an embodiment to which the present invention is applicable.

FIG. 17 is a perspective view which schematically shows the state that a glass for source document use is removed and a lid is open in an apparatus for forming image in accordance with a ninth embodiment to which the present invention is applicable. In accordance with the present embodiment, an aperture 45 is made larger than that of the eighth embodiment represented in FIG. 12 and FIG. 13, and extended in the traveling direction of a recording carriage 8. A lid 46 is made larger accordingly. In these aspects, the present embodiment differs from the eighth embodiment. All the other aspects are substantially the same as those of the eighth embodiment.

In accordance with the ninth embodiment shown in FIG. 17, the recording heads 7 and the positional adjustment thereof are carried out after the recording carriage 8 shifts near to the central part of the aperture 45. At this juncture, the workability is further enhanced, because the aperture 45 is wider than the eighth embodiment, and also, the aperture 45 is positioned further away from each side of the aperture 47 of the upper frame 1*b*.

Here, in accordance with the eighth embodiment shown in FIG. 12 and FIG. 13, and the ninth embodiment shown in FIG. 17, each of the lids 33 and 46 is opened and closed centering on one end thereof. However, it may be possible to arrange a structure so that the lid can be removed from the partitioning member 31 completely. Also, for these embodiments, a description has been provided under the assumption that the second image reading carriage 34 is suspended in a state that it does not interfere with the opening and closing of each of the lids 33 and 46. However, if the lids 33 and 46 should interfere with the second image reading carriage 34 due to the structural arrangements of the image reading unit and image recording unit, it will suffice if only the second image reading carriage 34 is allowed to shift to the position where it does not interfere with the lids 33 and 46.

Figure 18:
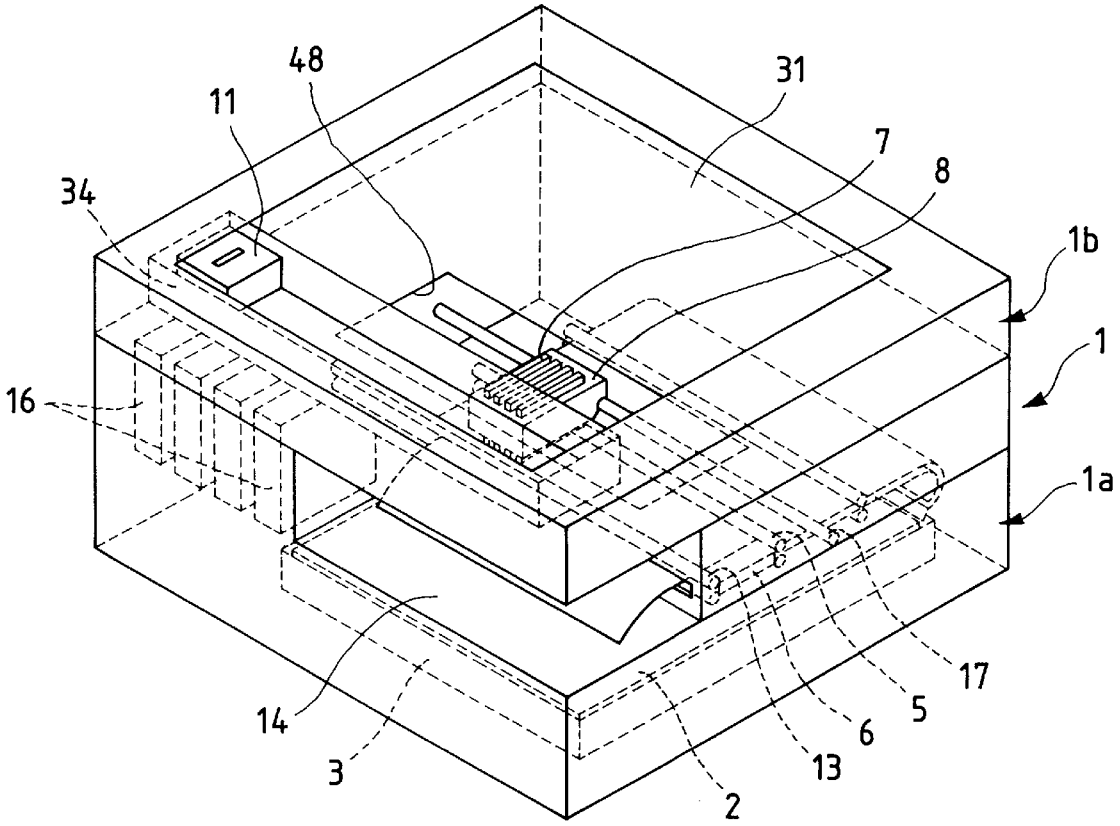
FIG. 18 is a perspective view which schematically shows an apparatus for forming images in accordance with a tenth embodiment as an embodiment to which the present invention is applicable.

FIG. 18 is a perspective view which schematically shows the state where a glass for source document use is removed in an apparatus for forming images in accordance with a tenth embodiment to which the present invention is applicable. For the present embodiment, only an aperture 48 is provided for a partitioning member 31. All the other parts of the present embodiment are substantially the same as those of the ninth embodiment. In accordance with the present embodiment, there is no lid 33 or 46, which is provided for each of the embodiments described above. As a result, even when exchanging the recording heads 7 and carrying out the positional adjustment thereof, it is unnecessary to open the lid, hence executing the operation more effectively. Also, it is more advantageous in items of cost.

Further, in accordance with the tenth embodiment shown in FIG. 18, it is possible to observe the operation of the image recording unit 1*a* without removing the glass 10 for source document use. For example, if any checking is needed to ascertain the abnormal condition of the image recording unit, it is possible to operate only the image recording unit 1*a* without operating the image reading unit 1*b*, and then, observe such condition through the glass 10 for source document use (not shown) and the aperture 48. In this way, it is possible to confirm the operating condition of the recording unit on the platen 6, and to determine the cause of any abnormal conditions easily in order to take necessary steps quickly as required.

Figure 19:
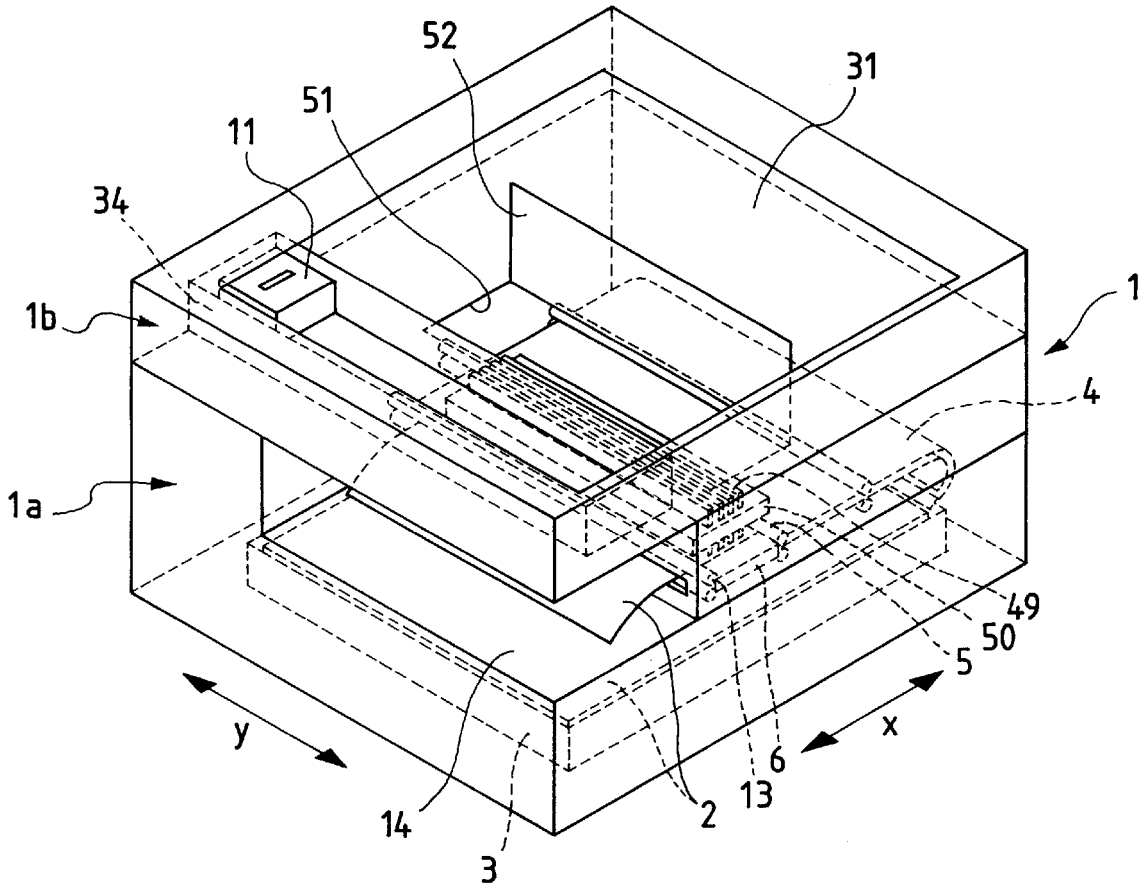
FIG. 19 is a perspective view which schematically shows an apparatus for forming images in accordance with an eleventh embodiment as an embodiment to which the present invention is applicable.

FIG. 19 is a perspective view which schematically shows the state that a glass for source document use is removed and a lid is open in an apparatus for forming images in accordance with an eleventh embodiment to which the present invention is applicable. In accordance with the present embodiment, there is mounted a full line type recording head 49, which is provided with the recordable area as recording means covering the entire width of a recording material 2 in the direction y. In other words, four colors (four pieces) of black, cyan, magenta, and yellow full line recording heads 49 are arranged in the direction x and mounted on a recording head holding stand 50.

Also, for the partitioning member 31 between the image reading unit 1*b* and the image recording unit 1*a*, an aperture 51 is arranged in a position above the line recording heads 49. The aperture 51 is opened and closed by means of a lid 52. All the other parts of the eleventh embodiment shown in FIG. 19 are structured substantially the same as those of the eighth embodiment represented in FIG. 12 and FIG. 13.

In accordance with the present embodiment, the structure becomes simpler, because the recording carriage 8, the guide shaft 17, and others provided for the previous embodiments are not needed. Further, recording is possible at high speeds without the traveling of the recording head 49. Also, for the present embodiment, there is provided the positional adjustment mechanism for the recording head whose principle is the same as that of the recording head positional adjustment mechanism described in conjunction with FIG. 14 to FIG. 16. Therefore, the position of the recording head 49 can be adjusted on the x-y plane. When this recording head positional adjustment is operated, the glass 10 for source document use (not shown) is removed and the lid 52 is opened. Thus, it is easy to exchange the recording heads 49 and carry out the positional adjustment thereof through the aperture 51.

Here, for each of the embodiments described above, it has been exemplified that the present invention is applied to an ink jet recording apparatus. However, it is equally possible to apply the present invention to an apparatus for forming images of other types, such as a wire-dot, a thermo-sensitive, and a thermal transfer type, and to obtain the same effects.

Also, for each of the embodiments described above, an apparatus for forming images provided with the functions of a copying machine having an image recording unit and an image reading unit arranged therefor has been exemplified for the description thereof. However, it is equally possible to apply the present invention to an apparatus for forming images provided with only a recording function or with a recording function and other functions, and to obtain the same effects.

Also, for the embodiments represented in FIG. 1 to FIG. 11, the descriptions have been provided by exemplifying an apparatus for forming images of a serial type where recording means is caused to travel in the main scanning direction. However, it is equally possible to apply the present invention to the apparatus of a line type where recording is performed only by means of sub-scanning by line type recording means having the length that covers a part of or the entire width of a recording material, and to obtain the same effects.

Further, for each of the embodiments described above, it has been exemplified that four pieces of recording heads are used for color recording. However, it is equally possible to apply the present invention to the gradation recording that uses a plurality of recording heads, to the recording that uses a single recording head, or to the recording to be made by the combination thereof, and to obtain the same effects.

Further, when the present invention is applied to an ink jet recording apparatus, it can be adopted for the recording head that uses electromechanical transducing elements such as piezoelectric elements. Particularly, however, the present invention can produce an excellent effect on an apparatus for forming images that uses the recording head to discharge ink by the utilization of thermal energy, because the adoption of such method makes it possible to attain a highly densified and precise recording.

In accordance with the embodiments described above, it has been clear that an apparatus for forming images that records images by recording means on a recording material is provided with an upper frame and a lower frame, and that the upper frame is installed to be opened and closed with respect to the lower frame by means of a rotational center arranged in the direction along the feeding direction of the recording material, and then, for the lower frame, a recording material carrying mechanism and an installation unit for recording means are provided, thus arranging a structure so that when the upper frame is opened or closed with respect to the lower frame, recording means is suspended on the rotational center side in a location outside the recording material carrying area of the apparatus main body. Therefore, it is possible to provide an apparatus for forming images capable of carrying out jamming disposal easily even when a recording material is jammed in the apparatus main body, and also, of eliminating the fear that the operator touches recording means by his hand at the time of jamming disposal so as to get the adjusted position of recording means out of order.

Further, in accordance with the embodiments described above, an apparatus for forming images that records images by recording means on a recording material is provided with an upper frame and a lower frame. The upper frame is installed to be opened and closed with respect to the lower frame by means of the rotational center arranged in the direction intersecting the recording material carrying direction, and the structure is arranged so that when the upper frame is opened or closed with respect to the lower frame, recording means is suspended in a location out of the recording material carrying area. Therefore, it is possible to provide an apparatus for forming images capable of carrying out jamming disposal easily even when a recording material is jammed in the apparatus main body, and of eliminating the fear that the operator touches recording means by his hand so as to get the adjusted position thereof out of order.

Also, in accordance with the embodiments described above, an apparatus for forming images that records images by recording means on a recording material is provided with an upper frame and a lower frame, as well as a partitioning member between the upper frame and the lower frame. Then, an aperture is arranged in a position on the partitioning member above recording means. Therefore, it is possible to provide an apparatus for forming images capable of executing the exchange of recording means and the positional adjustment thereof easily and quickly without removing its image reading unit.

What is claimed is:

1. An image forming apparatus for recording an image on a recording medium by recording means, said apparatus comprising:

a first housing for containing said recording means:

a second housing;

a rotation mounting portion for rotatably mounting said first and second housings around a rotation shaft so that said first housing is separable from said second housing;

a recording medium conveyance path provided in a direction along said rotation shaft;

a recording means mounting member for mounting and supporting said recording means; and moving means for serially moving said recording means mounting member in a direction for approaching and separating from said rotation shaft across said conveyance path, wherein said recording means mounting member is located outside of said conveyance path at a side of said rotation shaft at an open portion defined by a relative separation of said first and second housings when said first and second housings are separated.

2. An apparatus for forming images according to claim 1, wherein said recording means is an ink jet recording means provided with an exchangeable ink tank to supply ink to said recording means.

3. An apparatus for forming images according to claim 2, wherein said ink tank is arranged on the side for said upper frame to be opened thereto, said side being opposite to said rotational center of said lower frame.

4. An apparatus for forming images according to claim 1, wherein an image reading mechanism is provided, and read images are recorded on said recording material by use of said recording means.

5. An apparatus for forming images according to claim 1, further comprising carrying mechanism components formed entirely or partly by the rollers and guides arranged on the upper side of said recording material, and when said first and second housings are separated, said carrying mechanism components are caused to part from said recording material.

6. An apparatus for forming images according to claim 1, wherein said recording means is an ink jet recording means provided with electrothermal transducing elements to generate thermal energy to be utilized for discharging ink.

7. An apparatus for forming images according to claim 6, wherein said recording means utilizes film boiling created in ink by thermal energy generated by said electrothermal transducing elements, and discharges ink from discharge ports.

8. An apparatus for forming images for recording images on a recording material by use of recording means, comprising:

an upper frame and a lower frame, said lower frame containing said recording means, and wherein a partitioning member is arranged between said upper frame and said lower frame;

wherein an aperture is arranged in a location of said partitioning member above said recording means; and wherein an image reading mechanism is provided for said upper frame, and read images are recorded on said recording material by use of said recording means.

9. An apparatus for forming images according to claim 8, wherein a lid is arranged to be able to open and close said aperture.

10. An apparatus for forming images according to claim 8, wherein said recording means is provided with an ink jet recording head detachably mountable on said lower frame or an adjustment mechanism for adjusting the position of an ink jet recording head with respect to said lower frame.

11. An apparatus for forming images according to claim 10, wherein said aperture is an aperture having a size larger than the size enabling said ink jet recording head to be mounted on or demounted from said lower frame or enabling the position of said ink jet recording head to be adjusted with respect to said lower frame.

12. An apparatus for forming images according to claim 8, wherein the image reading unit of said image reading mechanism is capable of being suspended in a position other than above said aperture or movable thereto.

13. An apparatus for forming images according to claim 8, wherein said recording means is an ink jet recording means provided with electrothermal transducing elements to generate thermal energy to be utilized for discharging ink.

14. An apparatus for forming images according to claim 13, wherein said recording means utilizes film boiling created in ink by thermal energy generated by said electrothermal transducing elements, and discharges ink from discharge ports.

* * * * *

UNITED STATES PATENT AND TRADEMARK OFFICE

CERTIFICATE OF CORRECTION

PATENT NO. : 5,909,226

DATED : June 1, 1999

INVENTOR(S) : AKIO TAKEDA

Figure 20:
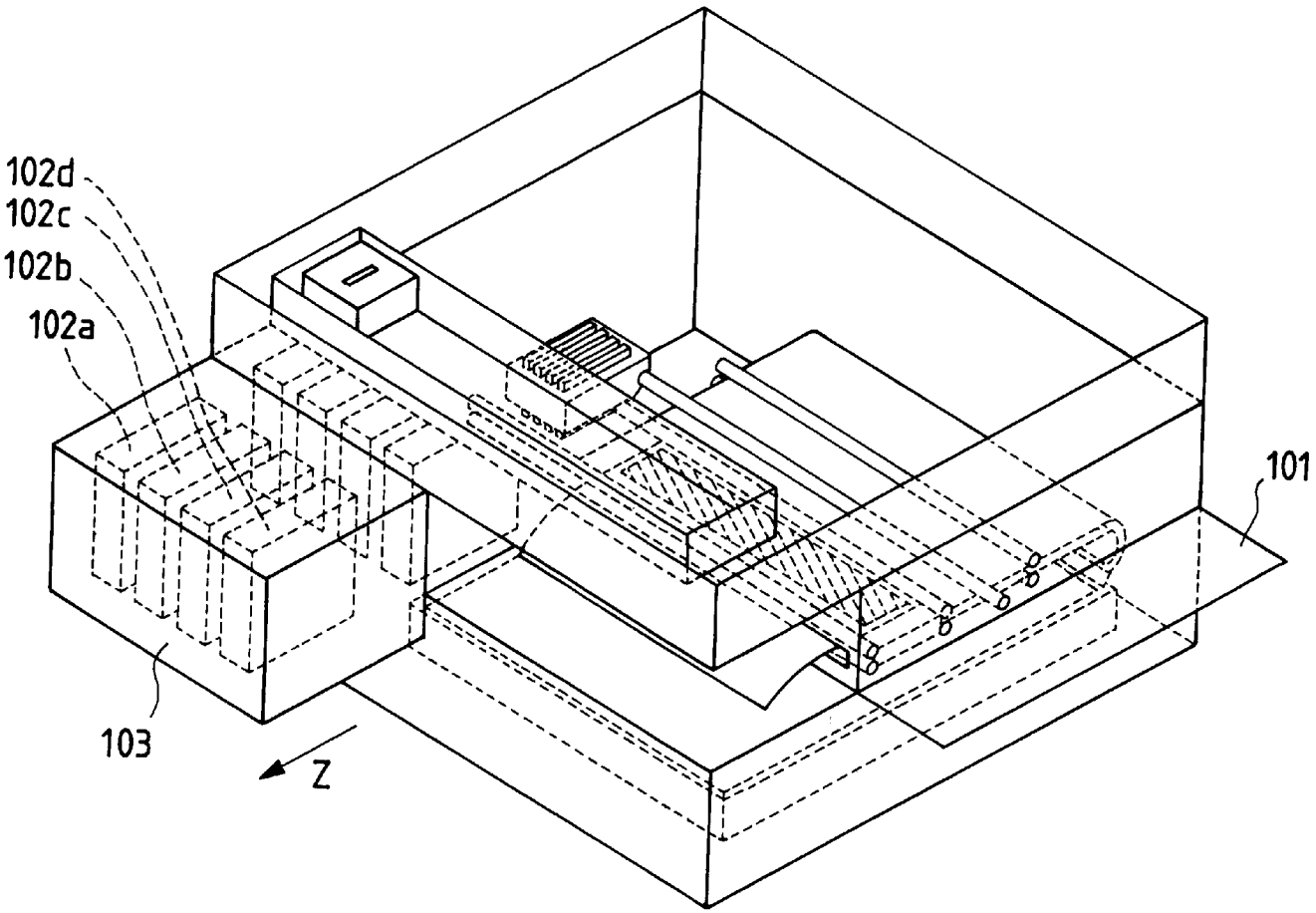
FIG. 20 is a perspective view which schematically shows one example of the conventional apparatus for forming images.

It is certified that error appears in the above-identified patent and that said Letters Patent is hereby corrected as shown below:

In the Drawings,
Figures 2 and 20 should be labelled --PRIOR ART--.

COLUMN 6,
Line 45, "the" (first occurrence) should read --a--.

COLUMN 8,
Line 15, "if" should read --1f--; and
Line 19, "if" should read --1f--.

COLUMN 10,
Line 53, "inserts" should read --insert--.

COLUMN 19,
Line 5, "items" should read --terms--.

COLUMN 21,
Line 12, "means:" should read --means;--.

Signed and Sealed this

Eleventh Day of January, 2000

*Attest:*

*Attesting Officer*

Q. TODD DICKINSON

*Acting Commissioner of Patents and Trademarks*